US010920291B2

(12) United States Patent
Sahajwalla et al.

(10) Patent No.: US 10,920,291 B2
(45) Date of Patent: Feb. 16, 2021

(54) SURFACE TREATMENT PROCESS

(71) Applicant: Commonwealth Steel Company Pty Ltd, St. Leonards (AU)

(72) Inventors: Veena Sahajwalla, Brighton-le-sands (AU); Farshid Pahlevani, Kennsington (AU)

(73) Assignee: Commonwealth Steel Company Pty Ltd, St. Leonards (AU)

( * ) Notice: Subject to any disclaimer, the term of this patent is extended or adjusted under 35 U.S.C. 154(b) by 187 days.

(21) Appl. No.: 16/302,383

(22) PCT Filed: May 17, 2017

(86) PCT No.: PCT/AU2017/050458

§ 371 (c)(1),
(2) Date: Nov. 16, 2018

(87) PCT Pub. No.: WO2017/197455

PCT Pub. Date: Nov. 23, 2017

(65) Prior Publication Data

US 2019/0284653 A1 Sep. 19, 2019

(30) Foreign Application Priority Data

May 17, 2016 (AU) ..... 2016901845

(51) Int. Cl.

| | |
|---|---|
| ***C21D 1/06*** | (2006.01) |
| ***C23C 8/66*** | (2006.01) |
| ***C23C 8/76*** | (2006.01) |
| *C21D 6/02* | (2006.01) |
| *C23C 12/02* | (2006.01) |

(52) U.S. Cl.

CPC ..... *C21D 1/06* (2013.01); *C23C 8/66* (2013.01); *C23C 8/76* (2013.01); *C21D 6/02* (2013.01); *C21D 2241/00* (2013.01); *C23C 12/02* (2013.01)

(58) Field of Classification Search

CPC ..... C23C 8/76; C23C 8/66; C21D 1/06
See application file for complete search history.

(56) References Cited

U.S. PATENT DOCUMENTS

| | | | |
|---|---|---|---|
| 1,984,411 | A | 12/1934 | Holt |
| 2,458,655 | A | 1/1949 | Sowa |

(Continued)

FOREIGN PATENT DOCUMENTS

| | | | |
|---|---|---|---|
| EP | 1712658 | A1 | 10/2006 |
| RU | 128879 | U1 | 6/2013 |

(Continued)

OTHER PUBLICATIONS

International Preliminary Report on Patentability dated Nov. 29, 2018 in International Patent Application No. PCT/AU2017/050458, 8 pages.

(Continued)

*Primary Examiner* — Jessee R Roe
(74) *Attorney, Agent, or Firm* — Shook, Hardy & Bacon L.L.P.

(57) ABSTRACT

A method of hardening a surface of a ferro-alloy object, the method comprising at least partially gasifying a carbon-containing polymer to form a hardening material source; and exposing the object to the hardening material source, such that the hardening material source and the surface of the object react, thereby hardening the surface of the object.

20 Claims, 23 Drawing Sheets

(56) References Cited

U.S. PATENT DOCUMENTS

| | | | |
|---|---|---|---|
| 2,458,665 | A | 1/1949 | Willard |
| 2006/0000523 | A1 | 1/2006 | Hotti |

FOREIGN PATENT DOCUMENTS

| | | | |
|---|---|---|---|
| WO | 199531584 | A1 | 11/1995 |
| WO | 2004027105 | A1 | 4/2004 |

OTHER PUBLICATIONS

Kadyrov, M., "Use of α-olefin mixtures as a liquid carburizing agent", Metal science and heat treatment, vol. 35, No. 12, pp. 667-669, 1993.
Torrey, J. et al., "Composite polymer derived ceramic system for oxidizing environments", J Mater Sci, vol. 41, p. 4617-4622, Jun. 30, 2006.
Examination report No. 2 dated Nov. 15, 2019 in Australian Patent Application No. 2017268035, 2 pages.
Notice of acceptance dated Dec. 2, 2019 in Australian Patent Application No. 2017268035, 3 pages.
Extended search report dated Dec. 18, 2019 in European Patent Application No. 17798400.2, 9 pages.
International Search Report and Written Opinion dated Aug. 4, 2017 in International Patent Application No. PCT/AU2017/050458, 11 pages.
Examination report No. 1 dated Jun. 21, 2019 in Australian Patent Application No. 2017268035, 3 pages.
Canadian Office Action received for Canadian Patent Application No. 3,023,217, dated Jul. 13, 2020, 4 pages.

SURFACE TREATMENT PROCESS

CROSS-REFERENCE TO RELATED APPLICATIONS

This application claims priority under 35 U.S.C. § 365 to PCT/AU2017/050458, filed on May 17, 2017, entitled "SURFACE TREATMENT PROCESS," which claims priority to Australian App. No. 2016901845, filed on May 17, 2016, the entirety of the aforementioned applications are incorporated by reference herein.

TECHNICAL FIELD

Surface treatment processes are disclosed. The surface treatment processes may find particular application in carburising, nitriding or carbonitriding the surface of a ferro-alloy object, and/or forming a ceramic surface on the surface of the ferro-alloy object. Ferro-alloy objects that incorporate surface treatments are also disclosed. The surface treat processes and ferro-alloy objects have particular application for grinding media, such as grinding balls, or other ferrous metallic object that may be subject to corrosion and wear.

BACKGROUND ART

Several methods for improving wear and corrosion resistance of ferrous metals have been proposed. Traditionally, the methods have not been cost effective, and have required high precision equipment and additional processing steps. Those processes that have been used in the manufacture of high-grade components, such as automotive parts, are not cost efficient for production of low-cost parts.

More recently, methods of enhancing the resistance of ferrous metal in bulk form through microstructure modification techniques (such as heat treatment, dispersion of the hard phase in ferrous metal matrix composite, and the addition of alloying elements), or by surface engineering techniques (such as application of coatings, films and surface treatments) have been proposed. Each have various limitations, including achieving surface modifications without affecting bulk properties of the ferrous metal, use of expensive additives, weak under impact force, inhomogeneous hard-phase distribution, reliance on specialised equipment, etc.

The above references to the background art do not constitute an admission that the art forms a part of the common general knowledge of a person of ordinary skill in the art. The above references are also not intended to limit the application of the surface treatment process as disclosed herein.

SUMMARY

According to a first aspect, a method of hardening a surface of a ferro-alloy object is disclosed. The method comprises at least partially gasifying a carbon-containing polymer to form a hardening material source, and exposing the object to the hardening material source. The hardening material source and the surface of the object react, thereby hardening the surface of the object.

In one form, hardening of the surface of the object may include carburising, nitriding or carbonitriding the surface of the ferro-alloy object, forming a ceramic layer on the surface of the ferro-alloy object, or a combination of such surface hardening techniques. The surface hardening technique employed may be dependent on the hardening material source formed from the carbon-containing polymer.

The hardening material source may be in gaseous, liquid or solid form, depending on the surface hardening technique being employed and the constituents of the carbon-containing polymer.

In this regard, during the at least partial gasification of the carbon-containing polymer, gases that may be formed include $CH_4$ (methane), CO (carbon monoxide), and $CO_2$ (carbon dioxide). Of these, $CH_4$ and CO are reducing components, which facilitate carbon solution into iron to form Fe (C), leading to carburisation and thus hardening of the surface of the object. Additionally, $CH_4$ can react with $CO_2$ and $H_2O$, both oxidising components, to generate further reducing components in the form of CO and $H_2$, which facilitates the carburisation process even further. The carbon-containing polymer may thus be considered as a carburising agent. Further, $CH_4$ can optionally be utilised as a fuel to provide a relatively cheap source of energy used to generate at least some of the heat used in the method.

The carbon-containing polymer and/or hardening material source may include other constituents, such as silicon, titanium, aluminium, and/or nitrogen etc. Such constituents may affect the mechanism by which surface hardening occurs. In this regard, the hardening material source may includes ceramic forming agents that form a ceramic surface on the object. These ceramic forming agents may include one or more ceramic phases that chemically bond with the ferro-alloy object. For example, aluminium present in the carbon-containing polymer may melt. This liquid aluminium may cover the surface of the ferro-alloy object. Due to aluminium's strong chemical affinity with oxygen, the liquid aluminium may bond with oxygen, forming aluminium oxide ($Al_2O_3$) on the surface of the ferro-alloy object. In another example, titanium oxide ($TiO_2$) may react with carbon generated from the at least partial gasification of the carbon-containing polymer component, leading to the reduction of titanium oxide. Nitridation of titanium to form titanium nitride (TiN), as a solid, may then occur, which can chemically bond to the surface of the ferro-alloy object. In yet another example, silicon, when in the form of silicon dioxide ($SiO_2$), may react with reducing gases and residue carbon generated from the at least partial gasification of the carbon-containing polymer component, leading to the reduction of $SiO_2$. When this occurs in the presence of nitrogen, silicon nitride ($Si_3N_4$) may be formed, as a solid, and chemically bond to the surface of the ferro-alloy object. It should be appreciated that more than one of these compounds may be formed and chemically bonded to the surface of the ferro-alloy object to form a ceramic surface to thereby harden its surface.

In one form, the ceramic forming agents are from metal and/or ceramic disposed in a complex source containing the carbon-containing polymer. In some forms, at least a portion of the metal and/or ceramic is incorporated in the polymer, disposed in the complex source separate to the polymer and/or at least a portion of the metal and/or ceramic is bonded to the polymer.

In some forms, at least part of the complex source is a complex industrial waste stream.

The carbon-containing polymer may comprise a waste polymer, such as a waste plastic or waste rubber. In this regard, the method disclosed herein may also be considered as a method of recycling a waste carbon-containing polymer.

Complex polymeric waste sources, such as metallised plastics, have been problematic to dispose of in an environmentally responsible manner. This is, in part, because the recoverable metal fraction is quite small and economies of scale dictate that the energy input required to recover the metal fraction far outstrips metal recovery.

Accordingly, complex polymeric waste has traditionally been sent to landfill sites or incinerated. Landfilling can result in toxins leaching into ground soil and water, and landfilling or incineration can lead to the release of harmful bi-products including greenhouse gases such as methane and carbon dioxide. With environmental side effects of landfilling and incineration techniques becoming less acceptable by modern society, alternative disposal techniques are sought. Accordingly, using the complex polymeric waste sources in the surface treatment process may allow both economic and environmental benefit.

The complex source including the carbon-containing polymer may comprise a metallised carbon-containing polymer. One such metallised carbon-containing polymer may include an aluminised carbon-containing polymer. The aluminium in the aluminised carbon-containing polymer may assist in the carburisation process by reacting with oxidising gases such as $CO_2$, which may be formed during gasification of the carbon-containing polymer, or $O_2$, which will almost inevitably introduced during sample preparation. The reaction of aluminium with $CO_2$ or $O_2$, prevents them from acting as oxidising components which would cause decarburisation of the surface. In this regard, the aluminium may be considered to enhance the reducing gases atmosphere for steel carburisation. The presence of aluminium may also reduce the need for, or amount of, additional reducing gases to be used. Aluminium may further assist in hardening the surface of the ferro-alloy object by diffusing into the surface. For example, atomized carbon and aluminium will diffuse into the ferrous metal structure. The reaction between carbon and aluminium (from the aluminised carbon-containing polymer) and chromium (Cr) and Manganese (Mn) present in the ferro-alloy object, allows a hard surface (such as $Cr_{23}C_6$, and $Al_4C$) to be formed.

Another complex source may include automotive shredder residue (ASR). ASR is, in general terms, the remaining parts of a motor vehicle after ferrous and non-ferrous metals have been separated, that has been shredded. ASR wastes can contain a combination of plastics, rubber, wood, fabric, non-ferrous metals, leather, glass, paper, colour additives, ceramics, glass and dirt. In this regard, ASR waste may include elements such as carbon, nitrogen, silicon, aluminium and titanium. The recycling of such metallised carbon-containing polymers has been difficult due to their complexity and heterogeneous nature.

The metallised carbon-containing polymer may be multi-layered, such as a laminate. Examples of multi-layered metallised carbon-containing polymers may include packaging materials that are used to prevent, for example, oxygen or water vapour from permeating through the packaging into its interior. Such materials may be used in the food industry, to keep food products fresher for longer and to prevent them from becoming stale, or in printer toner packaging to prevent moisture ingress. Generally, an ultra-thin layer of aluminium (about 40-100 nm) is deposited onto another substrate using a spray or vapour deposition technique in a process called metallising. Besides providing an effective barrier to atmospheric gases and aroma constituents, metallising also prevents light from entering. The recycling of such multi-layered metallised carbon-containing polymers has been difficult due to their complexity. For example, due to the nature of the material including thin layers of polymer and metal, traditional recycling techniques to recover the metal have not been appropriate due to the relatively small fraction of recoverable metal and energy input required. As the multi-layered metallised carbon-containing polymers do not need to be delaminated and separated into the different components (i.e. the polymer components and the metallic components), the method disclosed herein may also be considered as providing a cost effective and environmentally responsible method of recycling such multi-layered metallised carbon-containing polymers.

It is understood that when a carbon-containing polymer is at least partially gasified, some residue, such as solid carbon, may remain. In this regard, the carbon-containing polymer need not undergo complete pyrolysis to be effective as a hardening material source. Some residual carbon (e.g. solid carbon) or other material may remain. In some forms, at least a portion of the solid residue may form the hardening material source. For example, and as outlined above, solid titanium nitride, formed by the reduction of titanium oxide and the subsequent nitridation of titanium, may form and be the hardening material source. Further, other residual material, such as materials that won't harden the surface of the ferro-alloy object will have a significantly smaller volume than the initial carbon-containing polymer and can be disposed of more efficiently, with fewer environmental side-effects.

When the term "ferro-alloy" is used herein it is intended to include a broad range of iron-carbon alloys (including steels having various carbon contents) and other iron-carbon and/or iron-based alloys, including ferrochromium, ferrochromium silicon, ferromanganese, ferrosilicomanganese, ferrosilicon, magnesium ferrosilicon, ferromolybdenum, ferronickel, ferrotitanium, ferrophosphorous, ferrotungsten, ferrovanadium, ferrozirconiurn etc.

The method may include heating the object prior to exposing the object to the hardening material source. This can assist in hardening the surface of the ferro-alloy object by promoting the reaction between the hardening material source and surface of the ferro-alloy object. The temperature to which the object is heated may be dependent on the composition of the object, as the shape of the object may deform or distort if the temperature to which the objected is heated is too high. For ferro-alloy objects, such as steel, they may be heated to, for example, approximately 750-1250° C.

The method may include simultaneously heating the object and forming the hardening material source. Again, this can assist by promoting the reaction between the hardening material source and surface of the ferro-alloy object. This may also assist in reducing the energy required to form the hardened surface, by using the same source of energy to simultaneously heat the object and cause the carbon-containing polymer to at least partially gasify. In this regard, the object and polymer may be heated to, for example, approximately 900-1550° C.

The polymer may be at least partially gasified in a chamber that is separate to, but in fluid communication with, the object. Such an arrangement may be suitable when the hardening material source is in gaseous form, such as when the carbon-containing polymer is being used as a carburising agent.

The method may include heating the object, or providing a heated object, and contacting the carbon-containing polymer with the heated object, such that the carbon-containing polymer at least partially gasifies. In this regard, heat from the object may transfer to the carbon-containing polymer. This heat transfer may cool the object and heat the carbon-containing polymer, causing it to decompose (i.e. to at least partially gasify). The object may be at a temperature of, for example, approximately 900-1250° C. when initially contacted with the polymer. In other forms, the object may transfer heat to the carbon-containing polymer indirectly, such as by heat transfer associated with mechanisms including convection and radiation from the object.

In one form, the object may be heated as part of the process of manufacturing the object. In this regard, the method disclosed herein may form part of the manufacturing process of the object. In such forms, this may reduce the additional energy input required to form the hardened surface on the ferro-alloy object. In other forms, the object may be heated subsequent its manufacture.

The hardening material source and the surface of the object may react by chemically bonding the hardening material source to the surface of the object. For example, a ceramic surface layer may form on the surface of the object. Diffusion of the hardening material source into the surface may also occur.

The method may include selecting the duration for which the object is exposed to the hardening material source, to control a resulting thickness of the hardened surface. The duration may also be selected so as to control the type of surface hardening occurring on the surface of the ferro-alloy object.

The method may include selecting the temperature of the object and/or the hardening material source to control the properties of the hardened surface.

The method may include selecting a heating profile (which is dependent on temperature and time) of the object and/or the hardening material source to control the properties of the hardened surface A temperature differential may exist between the object and the polymer. The temperature differential may assist in the formation of the hardened surface.

A ferro-alloy object produced according to the method of the first aspect is also disclosed.

According to a second aspect, a method of forming a diffusion layer at a surface of a ferro-alloy object is disclosed. The method comprises providing a heated ferro-alloy object and contacting said heated ferro-alloy object with a carbon-containing polymer such that the carbon-containing polymer at least partially gasifies to form a hardening material source. Said hardening material source diffuses into said ferro-alloy object to form said diffusion layer.

The method disclosed in the second aspect may be otherwise as disclosed in the method of the first aspect. A ferro-alloy object produced according to the method of the second aspect is also disclosed.

According to a third aspect, a method of forming a ceramic surface on a ferro-alloy object is disclosed. The method comprising heating a complex source incorporating a carbon containing polymer, metal and/or ceramic to form a hardening material source; and exposing the object to the hardening material source, such that the hardening material source and the surface of the object react to form the ceramic surface the object.

In some forms, the hardening material source includes the carbon containing polymer at least partially gasified and ceramic forming agents from the metal and/or ceramic that react with the ferro-alloy agent to form the ceramic surface.

In some forms, the gasified polymer in the hardening material source assists in formation of the ceramic surface on the object. In some forms, the gasified polymer in the hardening source reduces the temperature at which some of the reactions occur.

The method disclosed in the third aspect may be otherwise as disclosed in the method of the first aspect. A ferro-alloy object produced according to the method of the second aspect is also disclosed.

In various forms of the disclosed aspects, the ferro-alloy object may be a steel object. The formation of a hardened surface layer on the surface of the steel object may allow a steel with a lower-carbon content to be used for the bulk steel product, with other physical and mechanical properties being obtained from the hardened surface layer. For example, a final product which may have previously required the use of a high-carbon steel may now be formed using a medium-carbon steel with a hardened surface layer, as disclosed herein.

In various forms of the disclosed aspects, the ferro-alloy object may be grinding media, such as grinding balls, or other ferrous metallic object that may be subject to corrosion and wear. Grinding media are traditionally made of high carbon steel, and are used in various processes, such as in mills in the process of extracting minerals from ore. Grinding media are susceptible to abrasive wear and corrosion due to the aggressive environment, and may contaminate the ore with iron particles if the grinding media are not replaced as they get consumed by abrasion. The surface hardened ferro-alloy object disclosed herein may reduce the corrosion and wear of grinding media, comparative to traditional grinding media, which may lead to an improvement in the length of their service life, which can also result in cost savings.

According to a fourth aspect, disclosed is a method of forming grinding media having a ferro-alloy substrate and a hardened ceramic surface, the method comprising forming the ceramic surface on the ferro-alloy substrate by reacting a hardening material source with the ferro-alloy substrate, the hardening material source being formed at least in part from a complex source incorporating carbon-containing polymer and metal.

In some forms, the complex source is heated to form the hardening material source with the carbon-containing polymer at least partially gasified and containing one or more ceramic phases that chemically bond with the ferro-alloy substrate.

In some forms, the ferro-alloy substrate is heated to promote the reaction between the hardening material source and the substrate.

In some forms, the complex stream comprises at least one of aluminium, silicon and titanium.

In some forms, the complex source comprises two or more of aluminium, silicon and titanium.

In some forms, the ceramic phases that chemically bond with the ferro-alloy substrate comprise one or more of TiN, $Al_2O_3$ and $Si_3N_4$ phases.

In some forms, the hardening material source and the ferro-alloy core react by diffusion.

In some forms, during the at least partial gasification of the carbon-containing polymer, gases that may be formed include $CH_4$ (methane), CO (carbon monoxide), and $CO_2$ (carbon dioxide). Of these, $CH_4$ and CO are reducing components, which facilitate carbon solution into iron to form Fe (C), leading to carburisation and thus hardening of the surface of the substrate. Additionally, $CH_4$ can react with $CO_2$ and $H_2O$, both oxidising components, to generate further reducing components in the form of CO and $H_2$, which facilitates the carburisation process even further. The carbon-containing polymer may thus be considered as a carburising agent.

The method may include selecting the duration for which the substrate is exposed to the hardening material source, to control a resulting thickness of the hardened surface. The duration may also be selected so as to control the type of surface hardening occurring on the surface of the ferro-alloy substrate.

The method may include selecting the temperature of the substrate and/or the hardening material source to control the properties of the hardened surface.

The method may include selecting a heating profile (which is dependent on temperature and time) of the substrate and/or the hardening material source to control the properties of the hardened surface.

The method disclosed in the fourth aspect may be otherwise as disclosed in the method of the earlier aspects. Grinding media produced according to the method of the third aspect is also disclosed.

In a typical adaptation of the method according to any aspect, a complex polymeric waste source may be used, such as aluminised food packaging and/or ASR. The use of a complex polymeric waste source provides an effective means of disposal of the complex polymeric waste source, which otherwise poses environmental challenges. The use of a complex polymeric waste source to modify the surface properties of a solid ferro-alloy object is also disclosed.

Additionally, aluminised food packaging will have a relatively consistent composition to comply with various standards which ensure the packaging materials do not contaminate the food stored therein. Consistent composition of the complex polymeric waste source may simplify formation of a hardened surface on a ferro-alloy object, and may allow a relatively consistent method (such as time, temperature, etc.) to be employed.

BRIEF DESCRIPTION OF DRAWINGS

Notwithstanding any other forms that may fall within the scope of the surface treatment methods as set forth in the Summary, specific embodiments will now be described, by way of example only, with reference to the accompanying drawings in which.

DETAILED DESCRIPTION

Figure 1:
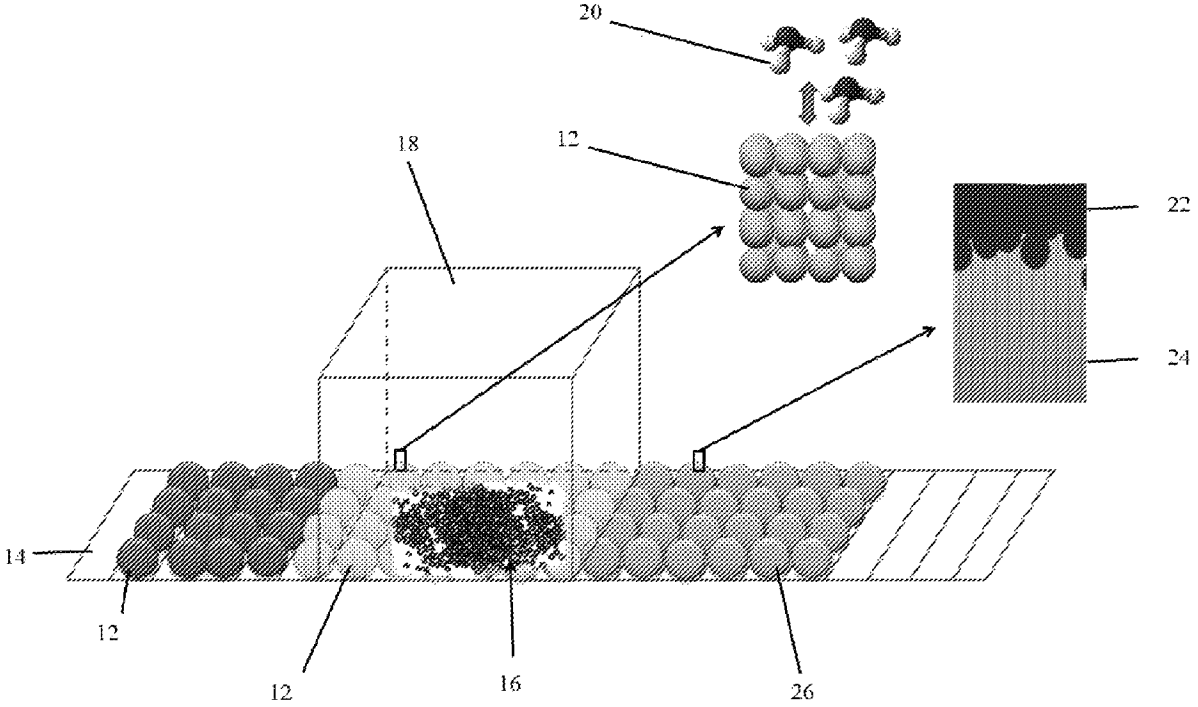
FIG. 1 shows a schematic illustration of an embodiment of a surface treatment process.

Referring firstly to FIG. 1, a general schematic illustration of an embodiment of a surface treatment process 10, as disclosed herein, is shown. The surface treatment process 10 shows ferro-alloy objects, in the form of steel balls 12 typically for use as grinding media, on a transport system such as a conveyor 14. A complex source 16 incorporating carbon-containing polymer and metal and/or ceramic, such shredded food packaging waste and/or automotive shredder residue (ASR), is positioned in chamber 18, and directly contacts the balls 12 as they move into the chamber.

In this embodiment, the steel balls 12 are still hot from their manufacture (not shown) and are in the process of cooling down when they are moved into chamber 18. In general terms, balls 12 will be at about 900-1200° C., cooling from a manufacturing temperature of about 1100-1200° C. Chamber 18 may be heated, or may be an insulated chamber to retain the heat of the steel balls 12. Due to the temperature differential between the hot balls 12 and relatively cooler complex source 16, heat transfer occurs thereby cooling the balls and heating the complex source. This causes various components in the polymer of the complex source 16 to gasify.

In some embodiments, such as those utilising food packaging waste as the complex source, various components in the complex source gasify to various gases 20, to form part of a hardening material source reacting with the surface of the balls 12 to form a diffused surface layer 22 with the core 24 remaining substantially the same. In other embodiments, such as those utilising ASR, various components in the complex source gasify to various gases 20. Constituents such as silicon, when in the form of silicon dioxide ($SiO_2$), may react with some of the gases 20, such as reducing gases $CH_4$ and CO, and residue carbon generated from the at least partial gasification of the carbon-containing polymer component, leading to the reduction of $SiO_2$. When nitrogen also forms part of the gases 20, silicon nitride ($Si_3N_4$) may be formed, as a solid, and chemically bond to the surface of the ferro-alloy object to form a hardened surface layer 22 with the core 24 remaining substantially the same. Accordingly, the hardening material source formed from the heating of the ASR and that reacts with the balls 12 is a complex mix of constituents in gas, liquid and/or solid form.

Figure 6:
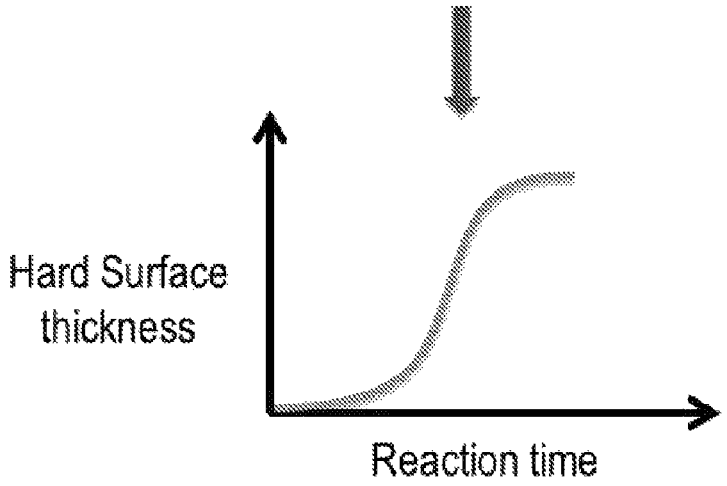
FIG. 6 shows a schematic of effect of time on the surface layer thickness.

As depicted in the schematic illustration shown in FIG. 6, the depth of the surface hardened region (surface layer 22, in FIG. 1) will depend on the time the hardening material source remains in contact with the balls. The surface hardened balls 26 are shown exiting the chamber 18 and will continue to cool.

Figure 2:
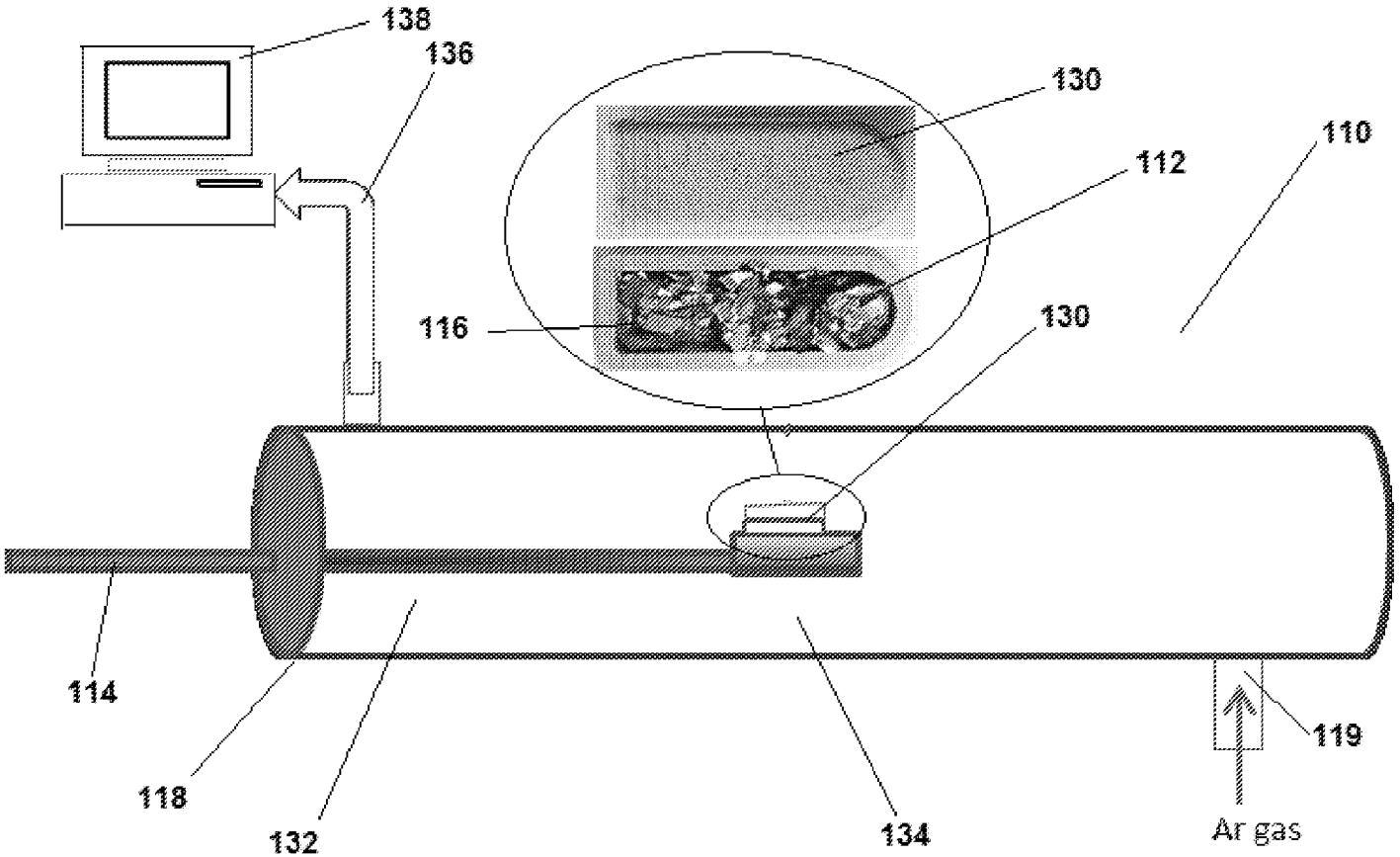
FIG. 2 shows a schematic illustration of an alternative embodiment of a surface treatment process, as described in Example 2.

Referring now to FIG. 2, a general schematic illustration of an alternative embodiment of a surface treatment process 110, as disclosed herein, is shown. Due to the similarities, like features will be numbered using like reference numerals, except that 100 has been added thereto (e.g. '10' now becomes '110', and so on). It should be appreciated that, in this embodiment, a laboratory-type experimental set-up is employed and that this experimental set-up can be used, as outlined in Example 2, to assist in determining the feasibility of the concept in general terms.

In this embodiment, ferro-alloy objects, in the form of LECO carbon calibration steel with 0.39 wt. % carbon 112, and a complex source incorporating carbon-containing polymers, in the form of aluminised plastic snack packaging bags 116, are combined in a covered alumina crucible 130. High purity (99.9%) argon gas was introduced at a flow rate of 1 L/min to horizontal tube furnace 118 via piping 119.

In this embodiment, instead of conveyor 14, a graphite specimen holder 114 is used to position the crucible 130 in a cold zone 132 (about 250-300° C.) of horizontal tube furnace 118, and hold it there for about 5-10 minutes to avoid thermal shock. The crucible 130, with the combined steel 112 and snack packaging bags 116, is then moved into the hot zone 134 (about 1200° C.) for a specified time. Once the specified time has elapsed, the holder 114 can be used to remove the crucible 30 from the hot zone 134 into the cold zone 132 for about 5 minutes. This was to minimise oxidation of the steel.

The gases generated during carburization were collected via piping 136 and monitored by an IR gas analyser 138 (Advance Optima model ABBs AO2020).

In an alternative embodiment, a zirconia crucible 130 was partially filled with a complex source incorporating carbon-containing polymer, in the form of ASR 116, steel with 0.4 wt. % carbon 112 was placed on top of the ASR and covered therewith so as to be tightly packed, and the crucible lid was replaced.

Figure 3:
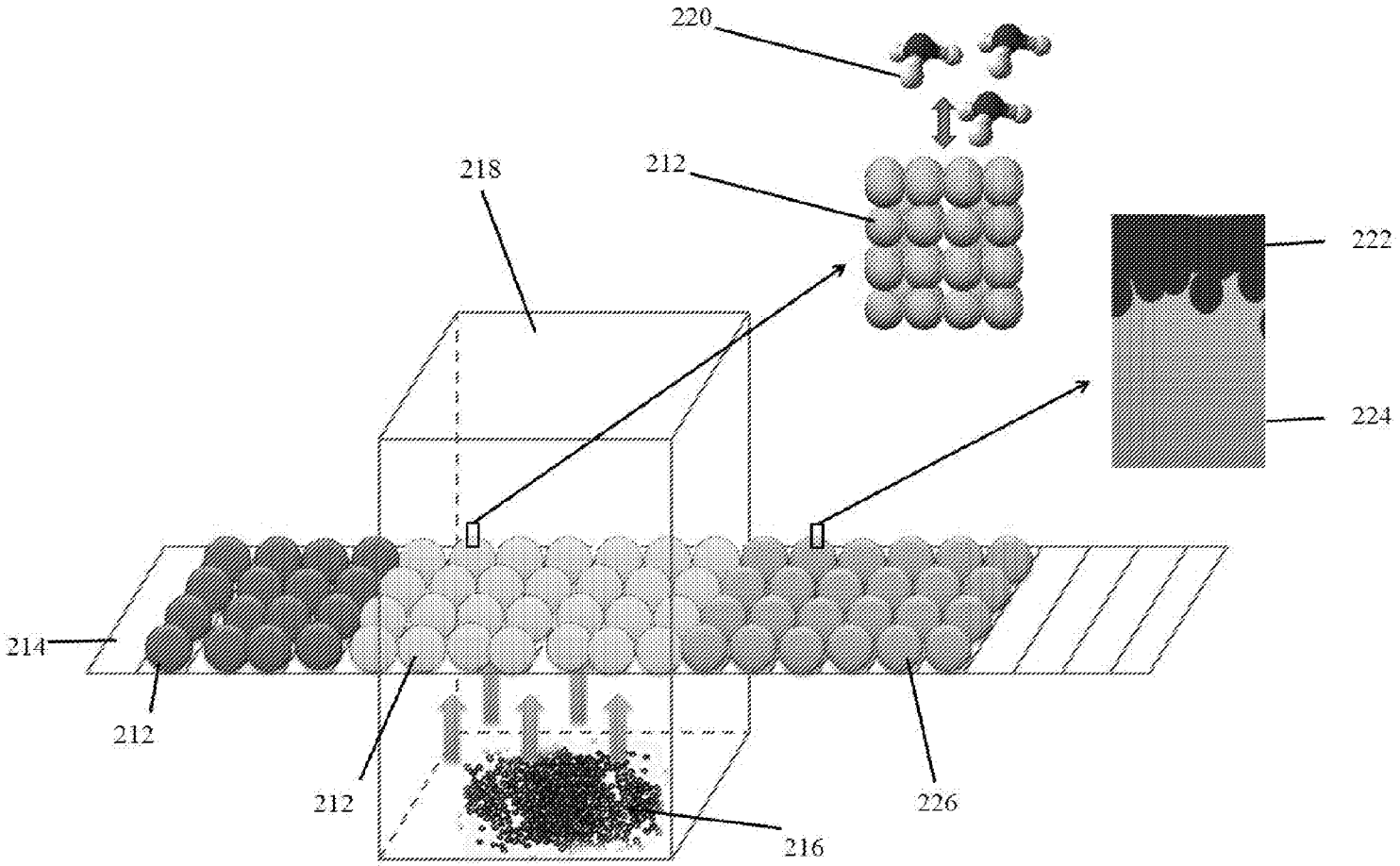
FIG. 3 shows a schematic illustration of a further alternative embodiment of a surface treatment process.

Referring now to FIG. 3, a general schematic illustration of a further alternative embodiment of a surface treatment process 210, as disclosed herein, is shown. Due to the similarities with surface treatment process 10 in FIG. 1, like features will be numbered using like reference numerals, except that 200 has been added thereto (e.g. '10' now becomes '210', and so on).

Unlike the embodiment depicted in FIG. 1, the complex source 216 incorporating polymer in the embodiment depicted in FIG. 3 is not in direct contact with the steel balls 212. In this embodiment, the complex source 216 sits below the balls 212. The complex source 216 may become heated by an external heating source (not shown) to form the hardening material source including gas 220 to harden the balls 212. In an alternative form, and in forms where this process forms part of the manufacturing process for the steel balls (and thus the steel balls are still hot), heat radiating or emanating from the steel balls may be sufficient to heat the complex source to cause generation of gas 220.

Figure 4:
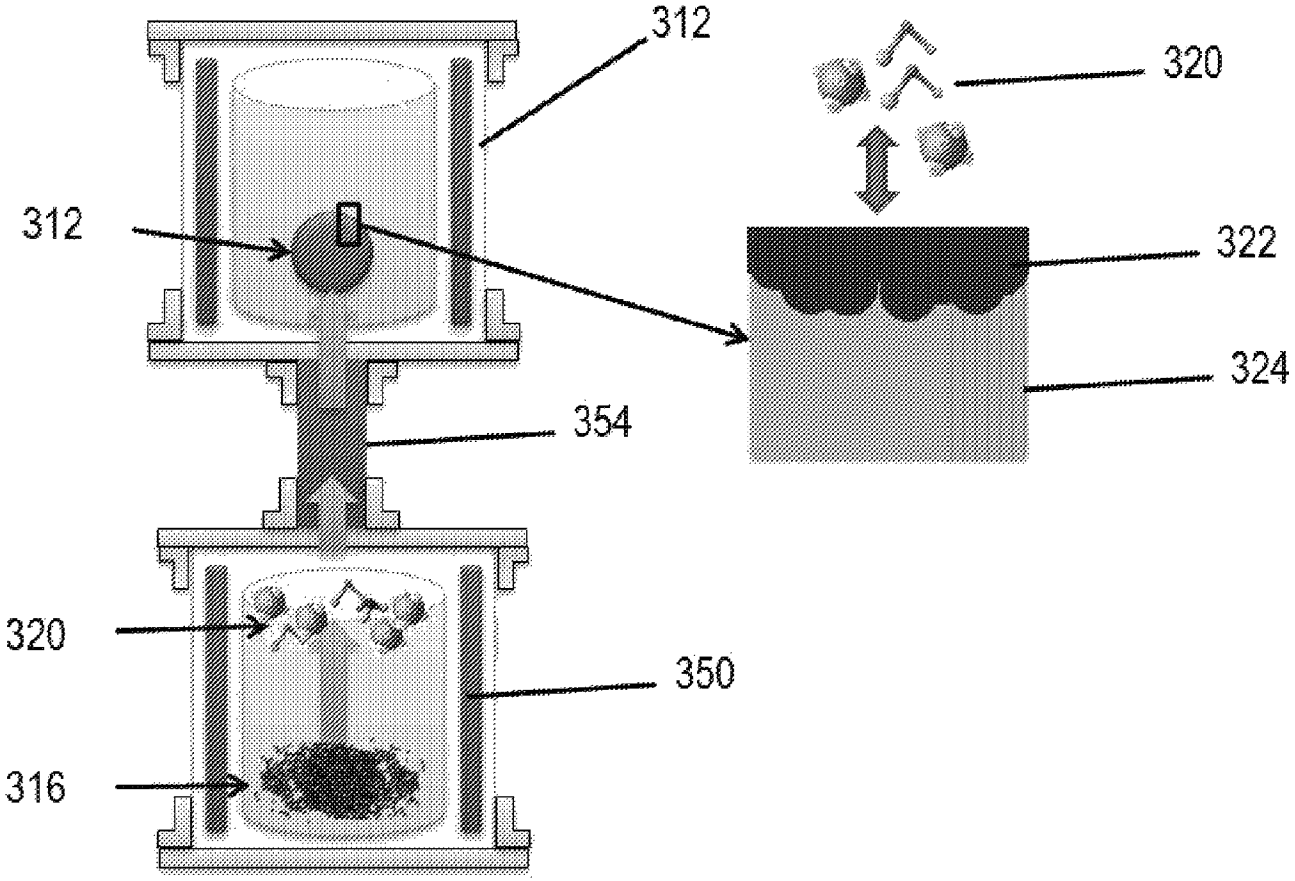
FIG. 4 shows a schematic illustration of yet a further alternative embodiment of a surface treatment process.

FIG. 4 depicts a general schematic illustration of yet a further alternative embodiment of a surface treatment process 310, as disclosed herein. Due to the similarities with surface treatment process 10 in FIG. 1, like features will be numbered using like reference numerals, except that 300 has been added thereto (e.g. '10' now becomes '310', and so on).

In the embodiment depicted in FIG. 4, the complex source incorporating the polymer 316 is located in a chamber 350 that is separated from the chamber 352 that contains the steel ball 312 via a pipe 354. As each of the chambers 350, 352 are separate, the complex source 316 and steel ball 312, respectively, can be independently heated (i.e. at different rates, for different times, to different temperatures, etc.). This may assist when the steel ball is undergoing a surface treatment process subsequent to its manufacturing process (i.e. if the steel ball has cooled and needs to be reheated). It may also be suitable for objects which have previously undergone a surface treatment process, been put into service (and, for example, the initial hardened surface has worn away), and are undergoing a subsequent surface treatment process.

Other embodiments, not depicted, are also envisaged. For example, the complex source may be introduced from a top chamber into a chamber containing the ferro-alloy objects, to provide a continuous supply of complex source from the above the ferro-alloy object. This may be in addition to the complex source situated below and/or in contact with the ferro-alloy objects, or may be as an alternative to the complex source situated below and/or in contact with the ferro-alloy objects.

Figure 5A:
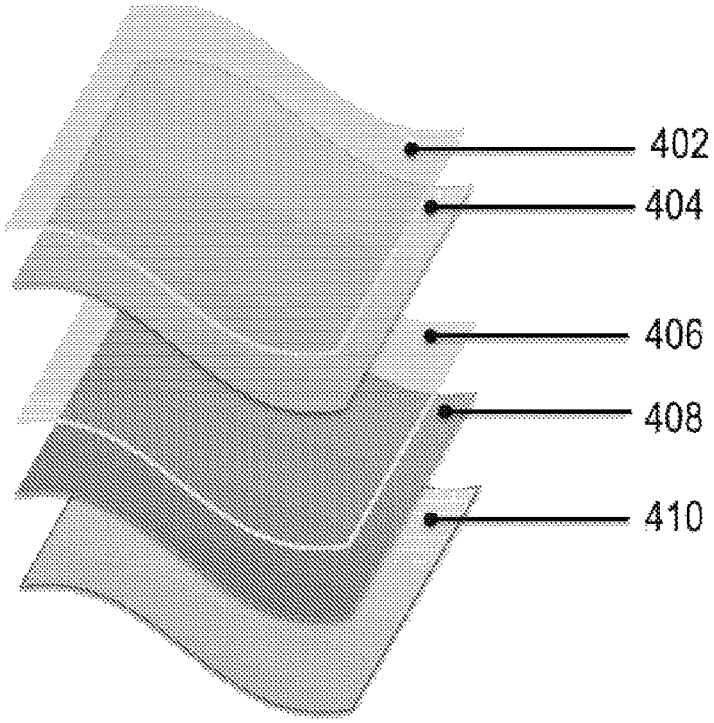
FIG. 5A shows a schematic illustration of a metallised multilayer polymer.

With reference now to FIG. 5A, a schematic exploded illustration of a metallised multilayer plastic 400 is shown. The metallised multilayer plastic 400 includes both polymer and metallic materials, and may include a coating 402, a metal layer 404, another coating 406, a first polymeric layer 408 and a second polymeric layer 410. The metallic material will often include aluminium, and the polymeric layers are carbon-rich and therefore can be used as the complex source. When the metallised multilayer plastic 400 is subjected to high temperatures, volatile species including $Al_{(g)}$, $AlO_{(g)}$ and $CO_{(g)}$ will form as part of the hardened material source. At high temperatures, these gasses will travel to the surface of the ferro-alloy object and by reaction at the surface of the ferro-alloy object, atomized carbon and aluminium will diffuse into the ferrous metal structure. The reaction between carbon and aluminium (from the waste material source) and chromium (Cr) and Manganese (Mn) present in the ferro-alloy object, will cause a hard surface to be formed.

Figure 5B:
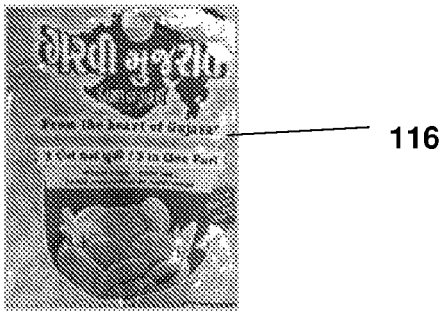
FIG. 5B shows an exemplary metallised multilayer polymer.
Figure 5C:
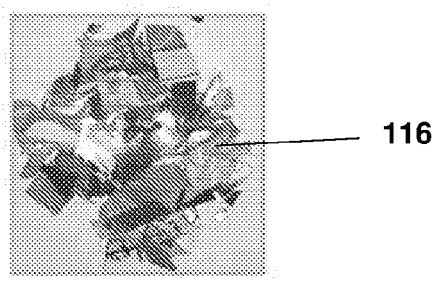
FIG. 5C shows the metallised multilayer polymer of FIG. 5B shredded.

FIGS. 5B and 5C depict a carbon-containing polymer, in the form of an aluminised plastic snack packaging bag 116 (and as shown in FIG. 2). In FIG. 5C, the plastic snack packaging bag 116 has been cut, slit, shredded, torn, chopped, sliced, grated, minced, etc., into smaller pieces to promote gasification of the plastic snack packaging bag 116 to form the material hardening source and to facilitate reaction with the surface of the ferro-alloy object. Laser ablation-inductively coupled plasma mass spectrometry (ICP) analysis confirmed the presence of aluminium in the exemplary snack packaging sample 116 (see Table 1).

TABLE 1

Elemental composition of exemplary snack packaging waste by ICP analysis

| | Element | | | | |
|---|---|---|---|---|---|
| Unit | C | Al | Si | Ca | Ti |
| Wt. % | 90.4 | 2.06 | 1.16 | 0.92 | 0.88 |

Figure 5D:
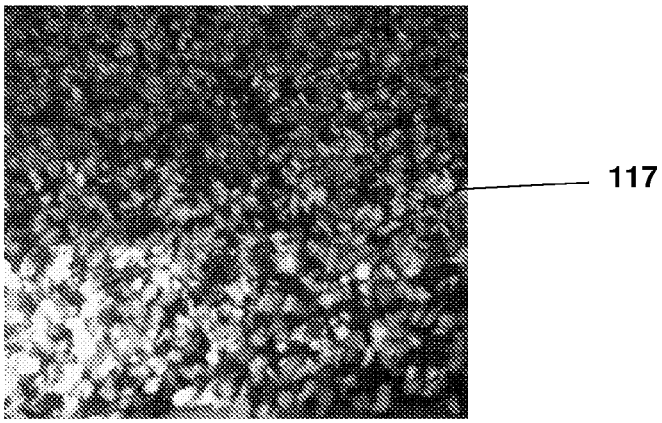
FIG. 5D shows an exemplary shredded metallised polymer.

FIG. 5D depicts a complex source including carbon-containing polymer, in the form of raw ASR 117. The chemical composition of exemplary raw ASR 117 is shown in Table 2, as well as the chemical composition of exemplary ASR treated at 1200° C.

TABLE 2

Chemical composition of exemplary ASR

| | Element | | | | |
|---|---|---|---|---|---|
| Unit | C | N | Ti | Si | Al |
| Wt. % (raw) | 19.43 | 0.72 | 2.68 | 0.49 | 0.1 |
| Wt. % (1200° C.) | 61.45 | 1.4 | 12.55 | 5.45 | 0.45 |

EXAMPLES

Non-limiting Examples of the surface treatment process will now be described, with reference to the Figures. In order to assess the suitability of complex polymeric waste sources to form a hardened surface on ferro-alloy objects. Examples 1 to 6 relate to the use of metallised waste plastics, in the form of plastic snack packaging bags, and Examples 7 to 10 relate to the use of metallised waste plastics, in the form of ASR.

Example 1

In order to assess the suitability of metallised waste plastics as a carburizer, analysis of a plastic snack packaging bag 116 was first conducted to determine its main constituents.

Figure 7A:
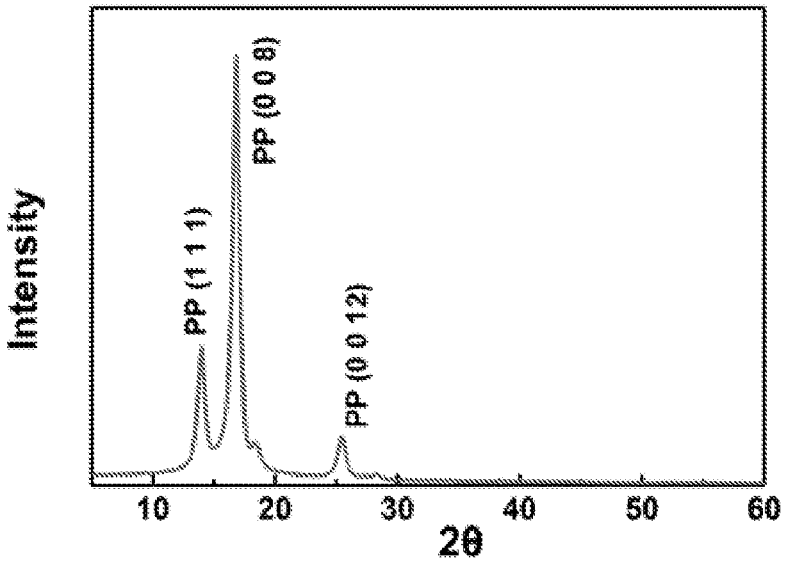
FIG. 7A shows the XRD pattern (peak analysis) for the metallised multilayer polymer of FIG. 5B, as described in Example 1.

Commonly used snack packaging bags, aluminised plastic, were collected and manually shredded into small pieces typically of the size<1 $cm^2$. The crystallographic characteristics of snack packaging waste was identified by X-ray diffraction (XRD, Empyrean Think Film). FIG. 7A shows the XRD pattern of exemplary snack packaging waste. It corresponds to the pattern of polypropylene, a typical crystalline thermoplastic polyolefin resin with main content of C and H. ICP analysis confirmed the presence of aluminium in the snack packaging sample, as shown in Table 1 above.

With the presence of aluminium and carbon in snack packaging confirmed, further proof of concept work was conducted.

Example 2

In order to further assess the suitability of metallised waste plastics as a carburizer, in situ analysis of a plastic snack packaging bag 116 with a calibration steel was conducted using a horizontal tube furnace. A schematic illustration of the experimental set up 110 of the horizontal tube furnace 118 is shown in FIG. 2.

LECO carbon calibration steel with 0.39 wt. % carbon 112, and carbon-containing polymers, in the form of aluminised plastic snack packaging bags 116, were combined in a covered alumina crucible 130. One piece of LECO carbon calibration steel 112, having the composition shown in Table 3, and 0.8 g of the shredded aluminised plastic snack packaging bags 116 (as shown in FIG. 5C), having the composition shown in Table 1 above, were put together in a covered alumina crucible 130 to work as a carburization sample.

TABLE 3

Alloy composition for LECO carbon calibration steel

| Element | Wt. % |
|---|---|
| Al | 0.004 |
| As | 0.003 |
| Ba | 0.004 |
| Ca | 0.015 |
| Co | 0.004 |
| Cr | 0.085 |
| Cu | 0.108 |
| Fe | 98.95 |
| Mn | 0.564 |
| Mo | 0.019 |
| Ni | 0.06 |
| Zn | 0.005 |

High purity (99.9%) argon gas was introduced at a flow rate of 1 L/min to the horizontal tube furnace 118 via piping 119. A graphite specimen holder 114 was used to position the crucible 130 in a cold zone 132 (about 300° C.) of the horizontal tube furnace 118. It was held there for about 5 minutes to avoid thermal shock.

The crucible 130, with the combined steel 112 and snack packaging bags 116, was then moved into the hot zone 134 (about 1200° C.) for a specified time of reaction. Once the specified time has elapsed, the holder 114 was used to remove the crucible 30 from the hot zone 134 into the cold zone 132 for about 5 minutes. This was to minimise oxidation of the steel.

Figure 7B:
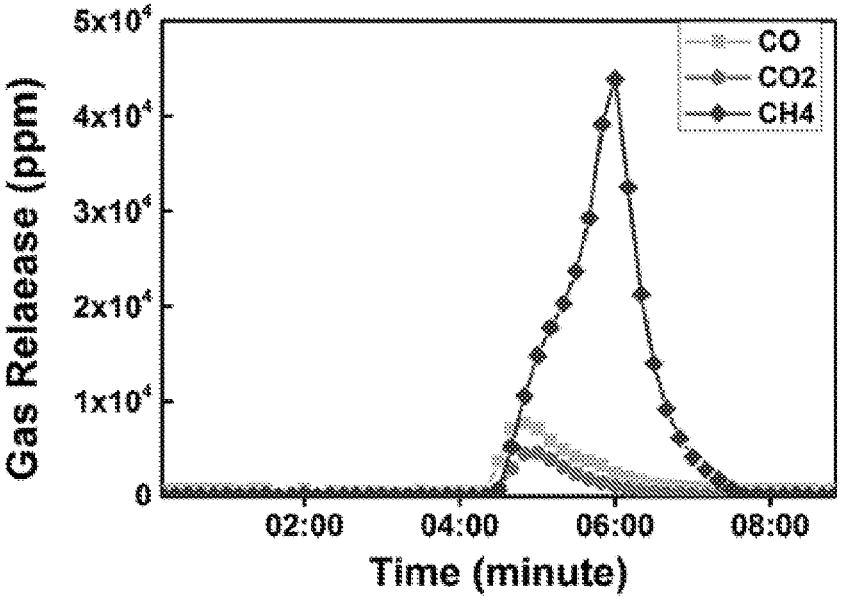
FIG. 7B shows gas emissions of the shredded metallised multilayer polymer of FIG. 5C in the surface treatment process of FIG. 2 at 1200° C. as a function of time, as described in Example 2.

The gases generated during carburization were collected via piping 136 and were monitored by an IR gas analyser 138 (Advance Optima model ABBs AO2020). IR gas analysis results showed that reduction gases such as CO and $CH_4$ were the main volatiles generated during pyrolysis of the snack packaging sample at 1200° C. (FIG. 7B).

Three reactions dominate the carbon absorption process from gas atmosphere into the steel surface, based on the American Society for Metals steel carburisation principle:

$$2CO+Fe \leftrightarrows Fe(C)+CO_2 \quad (1)$$

$$CH_4+Fe \leftrightarrows Fe(C)+2H_2 \quad (2)$$

$$H_2+CO+Fe \leftrightarrows Fe(C)H_2O \quad (3)$$

Fe (C) represents carbon solution in austenite (γ-Fe).

At high temperatures, each of these reactions are reversible, with carburisation and decarburisation occurring simultaneously over the whole process. CO, $CH_4$ and $H_2$ are reduction components, facilitating carbon solution into iron to form Fe (C) leading to carburisation. $CO_2$ and $H_2O$, on the other hand, are oxidising components, negatively carrying the carbon off from Fe (C) to cause decarburisation. The overall direction of a reaction depends on their corresponding equilibrium constants and gas composition in the whole atmosphere.

The dominant emission of $CH_4$ and CO from the snack packaging bags 116 evidenced the potential utilisation of snack packaging bags 116 as a carburisation agent for steel. Additionally, $CH_4$ can also react with $CO_2$ and $H_2O$ leading to generation of reducing gases, CO and $H_2$, to facilitate the carburisation process proceeding further. Further, $CH_4$ can optionally be utilised as a fuel to, to provide a relatively cheap source of energy.

Further analysis on the resulting sample was also conducted (see Example 3).

Example 3

In order to further assess the suitability of metallised waste plastics as a carburizing agent, microstructural analysis of the resulting steel from Example 2 was conducted using optical microscopy (OM, Nikon EM600L) and scanning electron microscopy (SEM, Hitachi 3400), as well as energy dispersive spectroscopy (EDS, Bruker X flash 5010). An untreated (raw) sample, a sample heated to 1200° C. for 10 minutes (with no carburising agent), and a sample heated to 1200° C. with snack packaging for 10 minutes were compared. The experimental procedure outlined in Example 2 was employed, including the use of LECO carbon calibration steel with 0.39 wt. % carbon.

Figure 8:
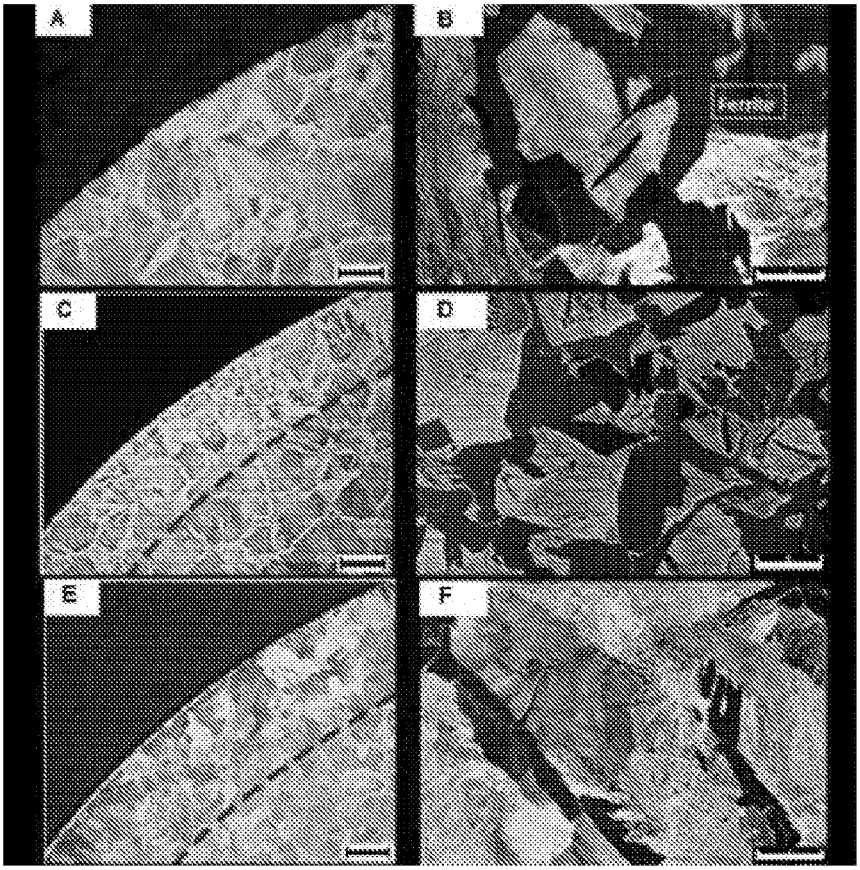
FIGS. 8A-8F respectively show microstructural characteristics for steel treated with different processes, as described in Example 3.

FIGS. 8A and 8B show an optical and SEM image, respectively, of the microstructure of the untreated steel sample (0.39 wt. % carbon). They show typical hypo-eutectoid steel constituents of some pearlite with a few pro-eutectoid ferrite (α-iron) phases lying along prior austenite grain boundary.

FIGS. 8C and 8D show an optical and SEM image, respectively, of the microstructure of the steel sample after treatment at 1200° C. for 10 minutes, without a carburising agent. More ferrite can be seen outlying the grain and subgrain boundary, indicating that decarburisation occurred on the surface of the steel sample.

FIGS. 8E and 8F show an optical and SEM image, respectively, of the microstructure of the steel sample after treatment at 1200° C. for 10 minutes, with 0.8 g of snack packaging. The pro-eutectoid ferrite content reduced significantly after this treatment, but the carbon-rich phase, iron carbide (cementite) dramatically increased at the surface of the steel sample with a depth up to about 0.3 mm. This demonstrated a typical eutectoid pearlite microstructure with a carbon content of about 0.7 wt. %.

EDS analysis was also conducted on these samples to reveal the carbon concentration variation of steel carburised under different conditions.

Figure 9:
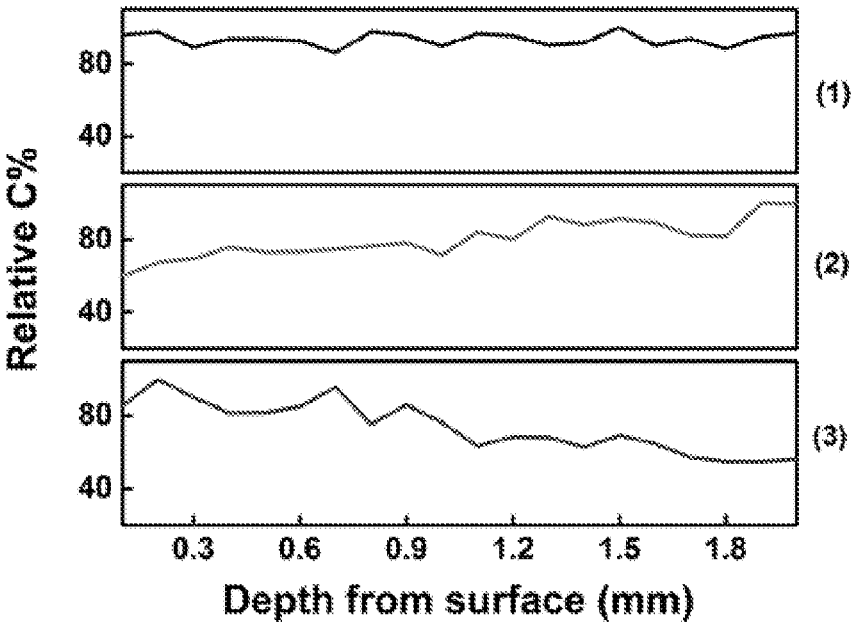
FIG. 9 plots relative carbon concentration-depth profile for steel treated with different processes at 1200° C. for 10 minutes, as described in Example 3.

As shown in FIG. 9 (1), the relative carbon concentration-depth profile of a raw steel sample ranges from about 86%~100%, indicating the reference carbon concentration fluctuation is 15%.

A steel sample that had been treated at 1200° C. for 10 minutes, without a carburising agent, had a relative carbon concentration range from about 60% 100%. As shown in FIG. 9 (2), there was an obvious decrease of carbon on the surface of the steel sample. This measurement correlated to the surface decarburisation phenomenon observed in FIGS. 8C and 8D. This decarburisation of the steel surface is attributable to the lack of reducing gases being present to protect the surface and prevent decarburisation from occurring.

As shown in FIG. 9 (3), the relative carbon concentration-depth profile on the surface of the steel sample treated at 1200° C. for 10 minutes, with 0.8 g of snack packaging, was increased.

As metallised waste plastics were found to be suitable for use as a carburising agent, additional analysis was conducted to determine the effect of time on their carburisation ability (see Example 4).

Example 4

In order to determine the effect of time on a metallised waste plastic's suitability for use as a carburising agent, microstructural analysis of the resulting steel was conducted using optical microscopy (OM, Nikon EM600L) and energy dispersive spectroscopy (EDS, Bruker X flash 5010) on steel samples heated to 1200° C. with snack packaging for 10, 20, 30 and 60 minutes were compared. The experimental procedure outlined in Example 2 was employed, including the use of LECO carbon calibration steel with 0.39 wt. % carbon.

The optical microstructural images shown in FIGS. 10A-10D respectively show steel samples heated to 1200° C. with 0.8 g of snack packaging for 10, 20, 30 and 60 minutes. As discussed in Example 3, in relation to FIGS. 8E and 8F, there was a dramatic increase in carbon-rich phase, iron carbide (cementite), at the surface of the steel sample with a depth up to about 0.3 mm for the samples heated for 10 minutes (see FIG. 10A). This demonstrated a typical eutectoid pearlite microstructure with a carbon content of about 0.7 wt. %. This significant eutectoid structure was also found on the surface of steel carburised for 20 minutes (see FIG. 10B). This indicated that the rich reducing gas liberated from snack packaging, CO and $CH_4$, reacted with steel leading to significant carburisation on the steel surface.

Figure 10:
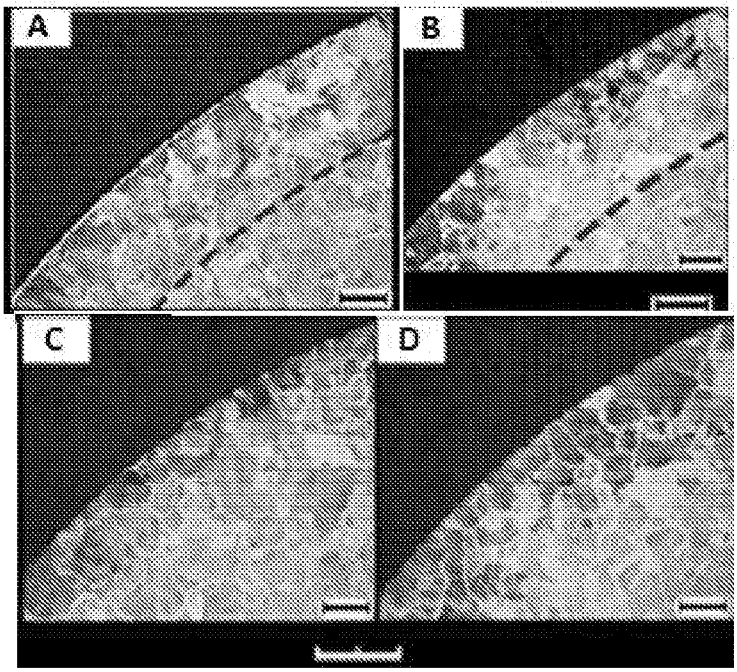
FIGS. 10A-10D respectively show microstructural characteristics for steel treated with the shredded metallised multilayer polymer of FIG. 5C in the surface treatment process of FIG. 2 at 1200° C. for different times, as described in Example 4.

With the extension of heating time to 30 minutes, see FIG. 10C, hypo-eutectoid microstructure with traces of pro-eutectoid ferrite phase outlining in the prior austenite grain boundary reappeared on the steel surface. This can be attributed to the shortage of reducing carbon gases decomposed from snack packaging wastes for the steel.

When the time was extended to 60 minutes, see FIG. 10D, more carbon-poor ferrite phase developed. This implied that some slight decarburisation occurred. This was likely a result of an inadequate supplement of reducing gases, and the depletion of carbon resources from the snack packaging wastes.

EDS analysis was also conducted on these samples to reveal the carbon concentration variation of steel carburised for different lengths of time. The relative carbon concentration-depth profile of a raw steel sample ranges from about 86%~100%, shown in FIG. 11 (1), indicating the reference carbon concentration fluctuation is 15%.

Figure 11:
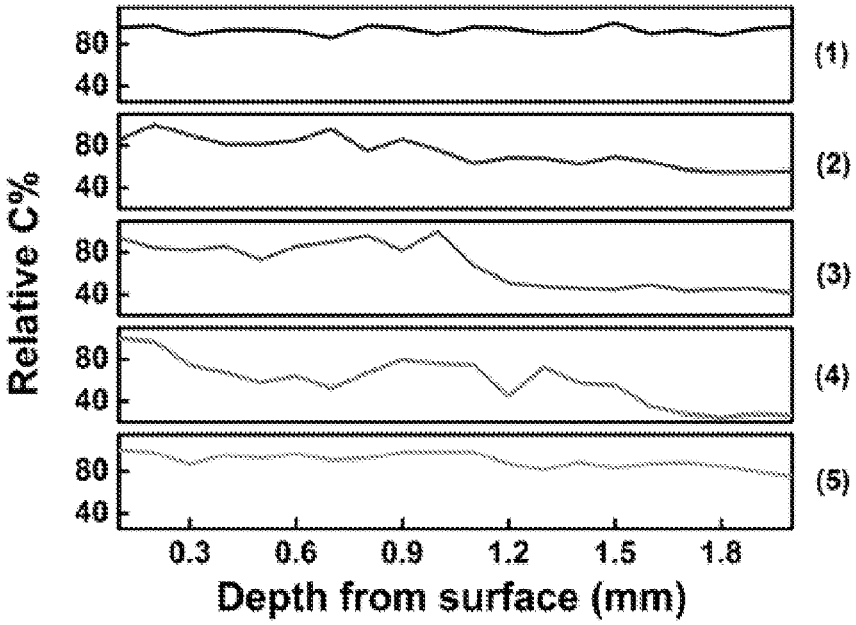
FIG. 11 plots relative carbon concentration-depth profile for steel treated with the shredded metallised multilayer polymer of FIG. 5C in the surface treatment process of FIG. 2 at 1200° C. for different times, as described in Example 4.

The steel samples treated at 1200° C. with 0.8 g of snack packaging for 10 and 20 minutes, shown in FIGS. 11 (2) and 11 (3) respectively, show that the relative carbon concentration-depth profile on the surfaces of these samples increased. However, when the treatment time was extended to 30 minutes, see FIG. 11 (4), the obvious increase of carbon concentration on the steel surface was reduced. When the treatment time was further extended to 60 minutes, see FIG. 11 (5), the carbon concentration fluctuation had returned almost back to the reference range of the raw sample (FIG. 11 (1)), with no substantial carbon gradient being detected.

These results correlated to the microstructures seen in FIGS. 10A-10D for corresponding samples.

Example 5

Additional analysis to confirm the quantitative carbon distribution of a steel sample treated at 1200° C. with 0.8 g of snack packaging for 10 minutes was also conducted. The experimental procedure outlined in Example 2 was employed, including the use of LECO carbon calibration steel with 0.39 wt. % carbon. The quantitative carbon concentration distribution was measured by an electron probe microanalyser (EPMA, JEOL JXA-8500F) fitted with four wavelength dispersive spectrometers (WDS) and a JEOL silicon drift detector energy dispersive spectrometer (SDD-EDS), with detection limits better than <0.05%.

Figure 12:
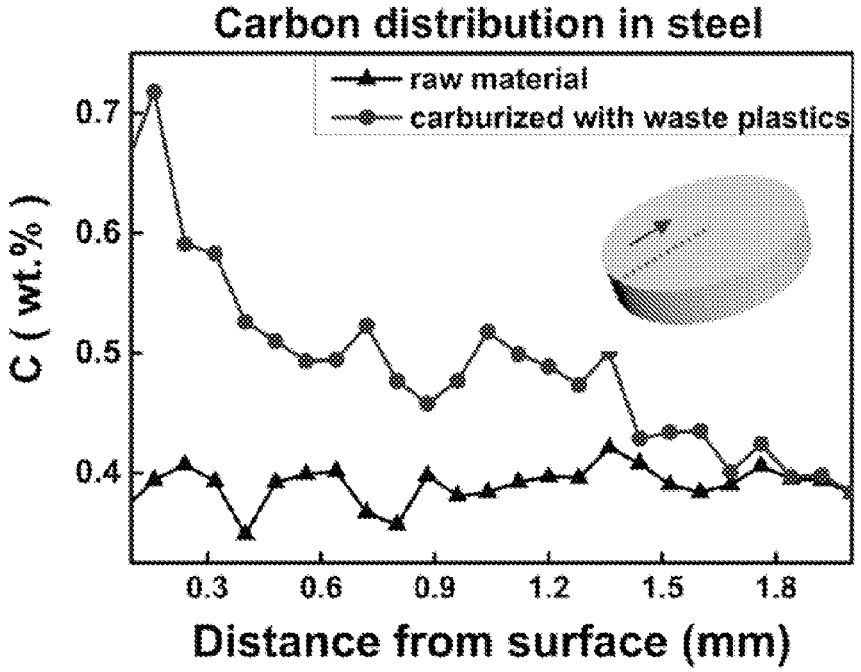
FIG. 12 compares the carbon concentration distribution in raw steel and in steel treated with the shredded metallised multilayer polymer of FIG. 5C in the surface treatment process of FIG. 2 at 1200° C. for 10 minutes, as described in Example 4.

FIG. 12 shows the carbon distribution of the raw LECO carbon calibration steel sample. It had an average of 0.39 wt. % carbon, with a standard deviation of 0.02 wt. %. This conformed to its calibration content (0.39 wt. %±0.005%).

The carbon distribution on the steel sample carburised with snack packaging for 10 minutes at 1200° C. showed a significant carbon gradient from the surface of the sample to its centre. The carbon concentration was higher than 0.55 wt. % to a depth of 0.3 mm, with a maximum carbon content of 0.72 wt. %. This maximum carbon content in this sample approximated the reference carbon content of eutectoid steel.

These measurements are consistent with the microstructural observations of the corresponding sample in Example 3.

Example 6

Additional analysis to understand the reaction between steel and aluminium in the snack packaging waste was conducted. The analysis was conducted on the surface of a steel sample treated at 1200° C. with 0.8 g of snack packaging for 10 minutes. The experimental procedure outlined in Example 2 was employed, including the use of LECO carbon calibration steel with 0.39 wt. % carbon. Chemical bonding states were characterised using an X-ray photoelectron spectrometer (XPS, Thermo ESCALAB250Xi).

Figure 13A:
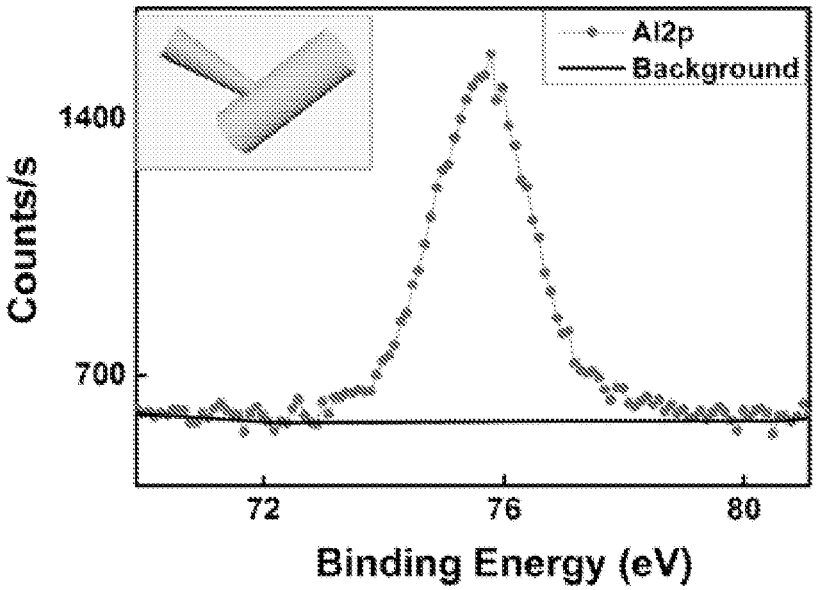
FIGS. 13A and 13B show, respectively, XPS spectra for aluminium detected on the surface of the carburized steel and for carbon contained in the carburized steel, as described in Example 5.

FIG. 13A shows the aluminium peak observed. Al2p peaked at 75.7 eV, which corresponds to aluminium oxide. This implies that the aluminium in the snack packaging waste preferentially reacted with oxidising gases, such as $CO_2$ or $O_2$ inevitably introduced during sample preparation, to enhance the reducing gases atmosphere for steel carburisation. An aluminium-oxide layer deposited on the steel surface might also work as a protective film for steel against wear and corrosion.

XPS analysis was also conducted on a polished cross-section of the carburised steel sample to determine the chemical state of carbon. The polished sample was ultrasonically cleaned in acetone for 5 minutes to eliminate hydrocarbon contamination on the surface. The selected area of analysis was ion beam sputtered for 10 minutes at a rate of 0.3 nm per second and each analysis point was sputtered again immediately before spectrum acquisition.

Figure 13B:
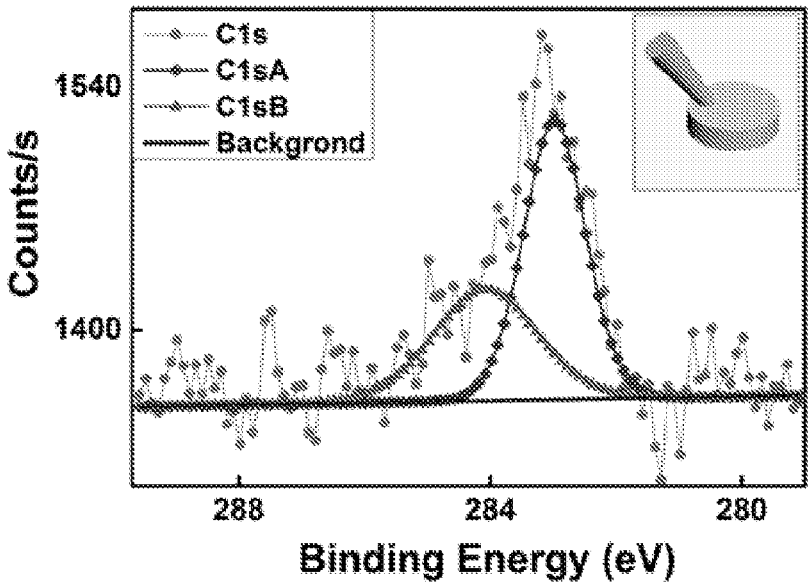

FIG. 13B shows the C1s spectrum detected in steel. It has two components, the predominant C1sA peak at 283.0 eV, which corresponds to a carbide compound, and the other smaller peak fitted at 284.1 eV, which corresponds to carbon solution in α-Fe.

Figure 13C:
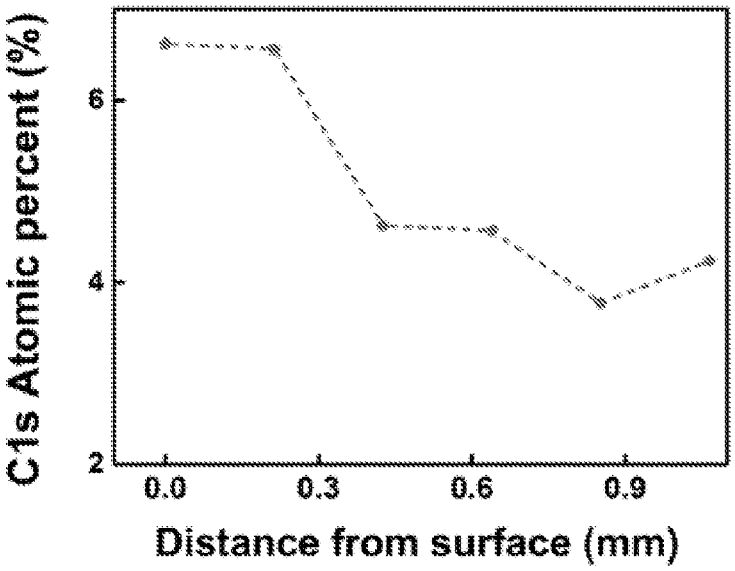
FIG. 13C shows the XPS line scan for carbon present-depth profile for steel treated with the shredded metallised multilayer polymer of FIG. 5C in the surface treatment process of FIG. 2 at 1200° C. for 10 minutes, as described in Example 5.

A finely focused X-ray beam of 200 μm, with step of 200 μm, was used to measure carbon content against depth profile in steel. FIG. 13C shows the line scan results of carbon concentration for the carburised steel sample. The higher carbon content at the surface of the sample, to a depth of about 0.3 mm, again confirmed that the packaging waste acted as a carburising sample.

Example 7

In order to assess the suitability of alternative complex polymeric waste sources to form a hardened surface on ferro-alloy objects, in situ analysis of ASR 117 with a medium-carbon steel was conducted using a horizontal tube furnace. The experimental set up was similar to the schematic illustration shown in FIG. 2, except that a zirconia crucible was used in place of the alumina crucible, ASR was used in place of plastic snack packaging bag 116, and 0.4% carbon steel was used.

The zirconia crucible 130 was partially filled with approximately 2.6-2.8 g of ASR, such as that shown in FIG. 5D. A 0.4% carbon steel pellet was placed inside the crucible and covered with the ASR so that the crucible was tightly packed. This was to avoid direct exposure of the steel sample to the heat of the furnace. The crucible lid was placed on the crucible to create a closed chamber for reaction.

As in Example 2, high purity (99.9%) argon gas was introduced at a flow rate of 1 L/min to the horizontal tube furnace 118 via piping 119. A graphite specimen holder 114 was used to position the crucible in a cold zone 132 (about 250-300° C.) of the horizontal tube furnace 118. It was held there for about 10 minutes to avoid thermal shock.

The crucible, with the combined steel pellet and ASR 117, was then moved into the hot zone 134 (about 1200° C.) for a specified time of reaction. Once the specified time has elapsed, the holder 114 was used to remove the crucible 30 from the hot zone 134 into the cold zone 132 for about 15 minutes. This was to minimise oxidation of the steel, and to prevent thermal cracking.

Figure 14:
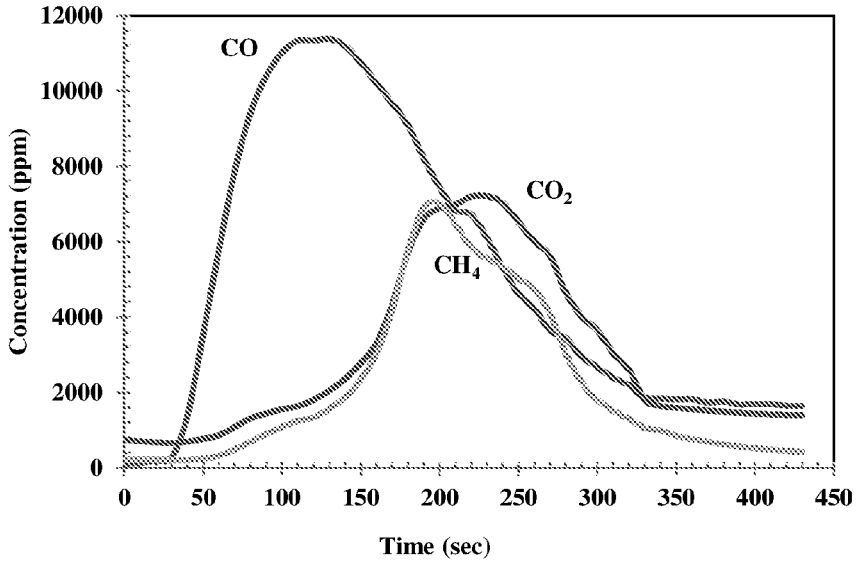
FIG. 14 shows gas emissions of the shredded metallised polymer of FIG. 5D in the surface treatment process of FIG. 2 at 1200° C. as a function of time, as described in Example 7.

The gases generated in the hot zone were collected via piping 136 and were monitored by an IR gas analyser 138 (Advance Optima model ABBs AO2020). IR gas analysis results showed that reduction gases such as CO, $CO_2$ and $CH_4$ were the main volatiles generated during pyrolysis of the ASR sample at 1200° C. (FIG. 14). As noted in Example 2, CO and $CH_4$ are reducing gases, and $CO_2$ is an oxidising gas.

Further analysis on these samples were also conducted (see Example 8).

Example 8

In order to further assess the suitability of alternative complex polymeric waste sources to form hardened surfaces on ferro-alloy objects, additional analysis to understand the reaction between steel and aluminium, silicon and titanium, respectively, in the ASR was conducted. The analysis was conducted on the surface of a steel sample treated at 1200° C. with ASR for 10, 20, 30 and 60 minutes. The experimental procedure outlined in Example 7 was employed, including the use of 0.4% carbon steel. Chemical bonding states were characterised using an X-ray photoelectron spectrometer (XPS, Thermo ESCALAB250Xi).

During the heat treatment of steel with ASR, it was observed that the organic materials in the ASR began to degrade and carbon-saturated gas was produced as indicated in FIG. 14. During this heat treatment, the C—C bond in the organic materials began to break down and the carbon reacted with the oxygen in titanium oxide and silicon oxide to form CO and $CO_2$. In general, it appears that three main phenomena were occurring on the steel surface; the melting of the existing aluminium and its reaction with oxygen to form aluminium oxide, the conversion of titanium oxide to titanium nitride, the reduction of silicon oxide and the formation of silicon nitride. Steel is a catalyst for all these reactions. As a result, the reduction of titanium oxide and silicon oxide and the formation of titanium and silicon nitride occur at a temperature lower than would be expected for the formation of nitrides. Also, at the same time, carbon from ASR will diffuse into the steel structure and react with the existing Mn in the steel structure and manganese carbide will form.

Figure 15A:
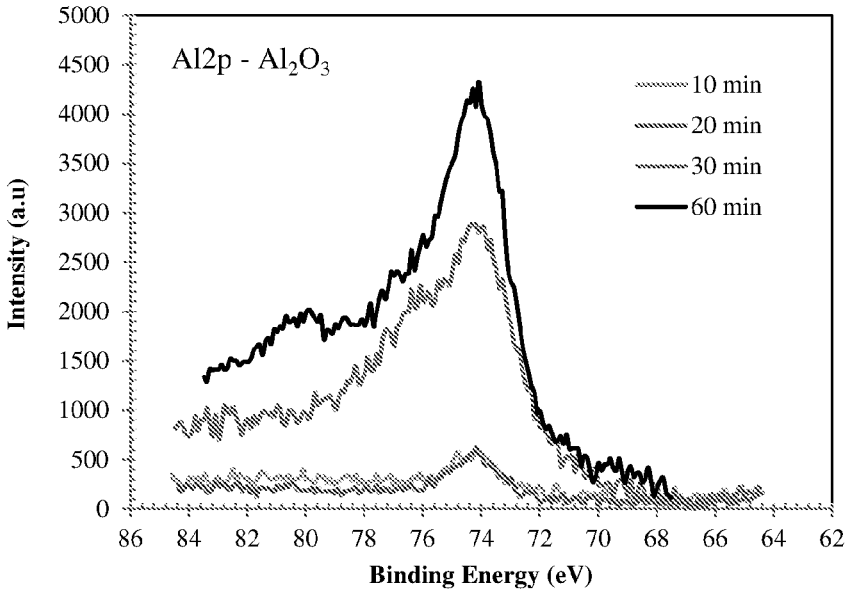
FIGS. 15A and 15B show, respectively, XPS spectra for aluminium detected on the surface of the treated steel and for silicon detected on the surface of the treated steel, as described in Example 8.

FIG. 15A shows the aluminium peak (Al2p-$Al_2O_3$) observed at 1200° C., for different treatment times. At longer reaction times, the intensity of Al2p increased, indicating that the thickness of the aluminium oxide surface layer increased.

ASR contains small amounts of aluminium which, at 1200° C., is in a liquid stage. Due to the good chemical bond between the structure of aluminium and iron and the low wettability angle between aluminium and steel, it covers the steel surface. On the other hand, aluminium has a very strong chemical affinity for oxygen and bonds easily with existing oxygen to form aluminium oxide on the steel structure. As this is an exothermic reaction, it is postulated that it will release energy and form local micro-reactors which encourage the formation of aluminium oxide at neighbouring sites. The XPS spectrum of Al2p in FIG. 15A shows the formation of this aluminium oxide surface at different heat treatment times. At longer reaction times the intensity of Al2p increases, which produces an increase in the thickness of the aluminium oxide surface.

In addition to aluminium, ASR contains silicon in the form of $SiO_2$, due to the presence of glass in the shredded waste mix. At 1200° C. the reaction between the silicon oxide, reducing gases and carbon residue from the degradation of organic components of ASR will lead to the reduction of $SiO_2$. During the process of $SiO_2$ reduction, the presence of nitrogen from plastic leads to the formation of silicon nitride as indicated in the equations 1 and 2. This enables the formation of silicon nitride ($Si_3N_4$) on the surface of the steel. The evidence for this is seen clearly in FIG. 15*b*, which shows the XPS spectra of the Si2p results for the samples. Generally, the formation of silicon nitride needs a higher temperature and longer exposure time, but in this study iron acts as a catalyst to promote the formation of silicon nitride at a lower temperature and Ar acts as a carrier gas in these reactions. However, compared with aluminium oxide, silicon nitride needs a longer reaction time to form; after 30 minutes the intensity of $Si_3N_4$ in the XPS spectra starts to increase.

$$3SiO_2+6C+2N_2 \rightarrow Si_3N_4+6CO \quad \text{Eq. (1)}$$

$$3SiO_2+6CH_4+2N_2 \rightarrow Si_3N_4+6CO+12H_2 \quad \text{Eq. (2)}$$

Figure 15B:
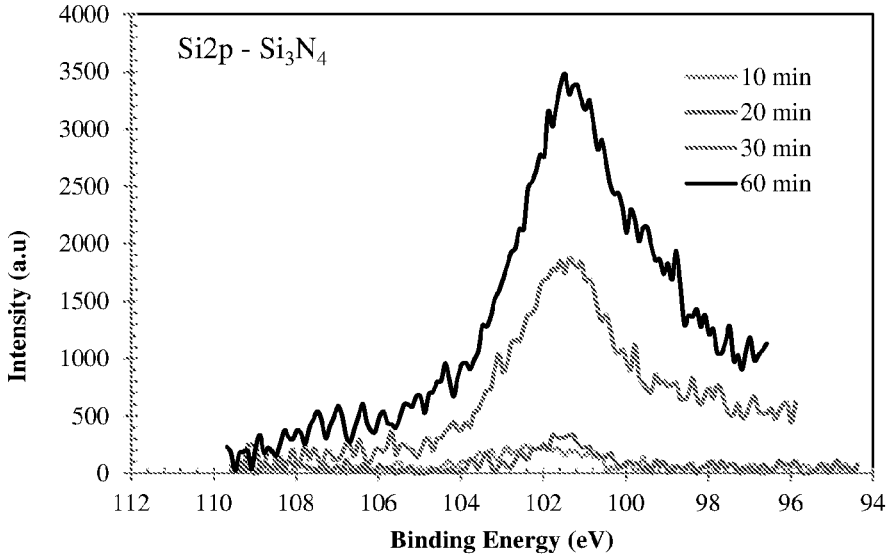

FIG. 15B shows the silicon peak (Si2p-$Si_3N_4$) observed at 1200° C., for different treatment times. The XPS spectrum shown in FIG. 15B confirms that silicon nitride ($Si_3N_4$) forms on the surface of the steel sample. It has been postulated that this is due to the reaction of $SiO_2$ (glass present in the ASR) with carbon (organic component of the ASR), leading to the reduction of $SiO_2$. It has been further postulated that during reduction of $SiO_2$, and in the presence of nitrogen (in plastics of the ASR), silicon nitride ($Si_3N_4$) is formed. Generally speaking, higher temperatures and longer reaction times are needed for silicon nitride to form. However, silicon nitride forms under the noted conditions of the present example. It is postulated that iron acts as a catalyst which promotes the formation of silicon nitride at lower temperatures, with argon acting as a carrier gas. FIG. 15B also shows that after 30 minutes, the intensity of Si2p begins to increase.

Another component in ASR is titanium oxide which is derived from titanium oxide pigment in the colours as well as the UV stabiliser in the plastics. It is postulated that the reduction of titanium oxide in ASR by carbon from degraded organic components has been followed by the nitridation of Ti to form TiN. This transformation of titanium oxide to titanium nitride will take place during the nitridation process as indicated in equations 3 and 4. The XPS spectra of Ti2p on the steel surface at different heat treatment times (FIG. 16A,B,C) show the formation of the Ti—N bond and transference on the Ti—O bond to Ti and then to a Ti—N bond.

$$2TiO_2+4C+N_2 \rightarrow 2TiN+4CO \quad \text{Eq. (3)}$$

$$3TiO_2+4CH_4+N_2 \rightarrow 2TiN+4CO+8H_2 \quad \text{Eq. (4)}$$

Figure 16A:
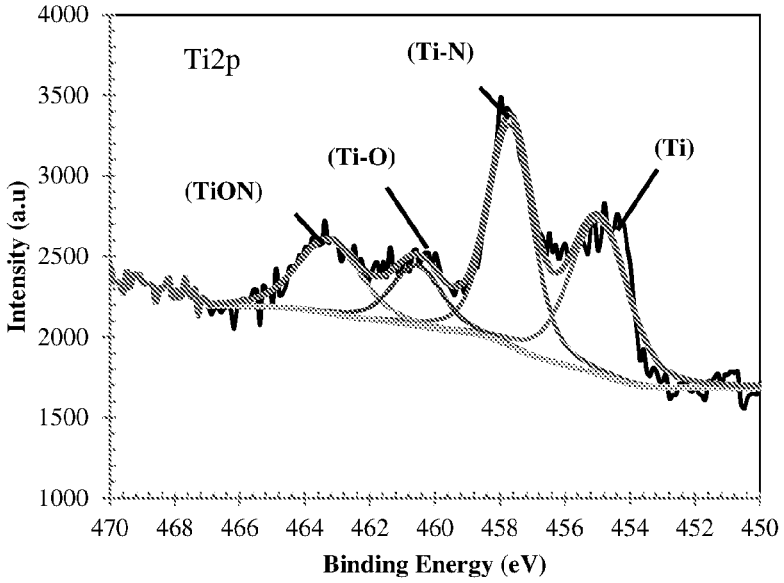
FIGS. 16A-16C show XPS spectra for titanium detected on the surface of the treated steel for treatment times of 20, 30 and 60 minutes, respectively.
Figure 16B:
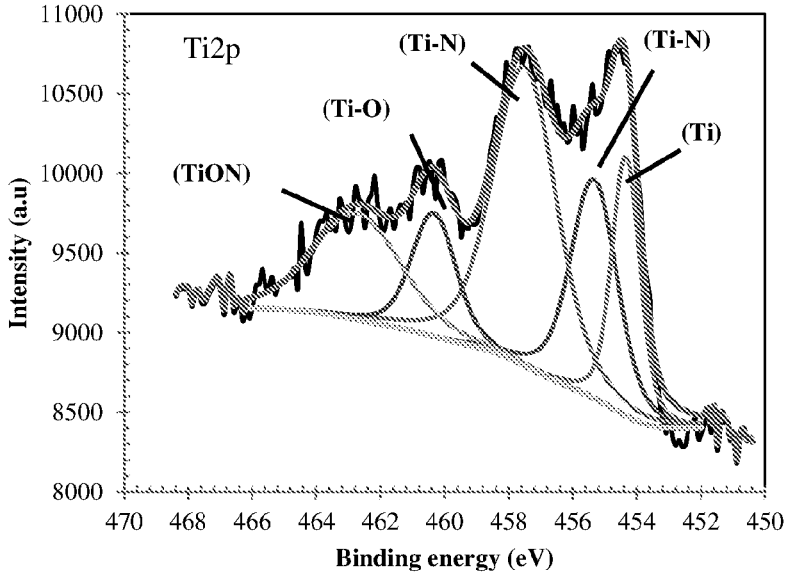
Figure 16C:
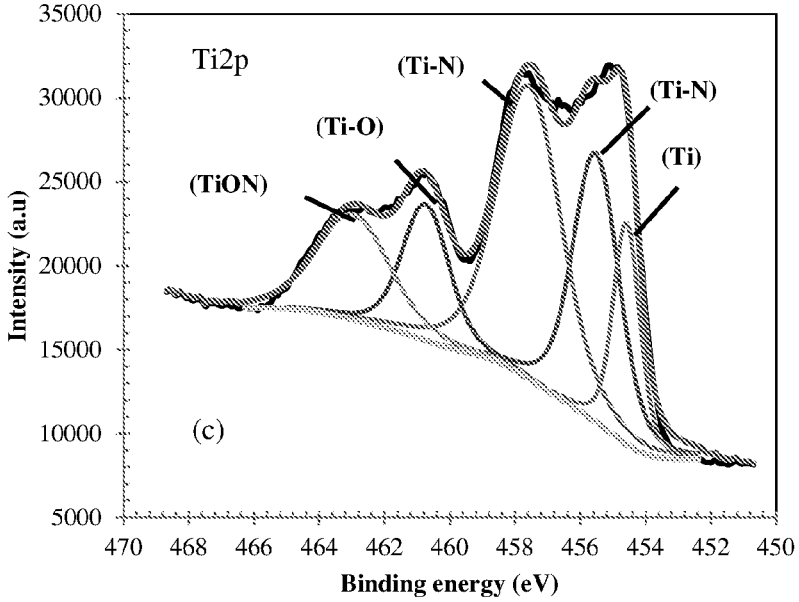

FIGS. 16A, 16B and 16C show the titanium peak (Ti2p) observed at 1200° C., for treatment times of 20, 30 and 60 minutes, respectively. These figures show the reduction of titanium oxide in ASR by carbon (organic component of the ASR), followed by nitridation of $TiO_2$ to form Ti N. For example, these figures show the formation of Ti—N bond and transferring Ti—O bond to Ti and then Ti—N bond.

Table 2 summarises the formation of the chemically-bonded ceramic surface on steel at different heat treatment times. As the table shows, the first ceramic surface which forms on the steel surface from 10 minutes is aluminium oxide because aluminium is in a liquid stage at 1200° C. and the reaction kinetic is fast. After 20 minutes a titanium nitride surface starts to form and after 30 minutes a silicon nitride surface appears. It is postulated that that hydrogen will accelerate the reduction of silicon oxide and titanium oxide and iron will work as a catalyst in the formation of different ceramic components. Given the small diameter of hydrogen atoms and their highly reactive nature, in particular with oxygen, it is postulated that the presence of hydrogen in the system increases the reduction speed of oxides. In the present samples, hydrogen from the degradation of organic components helps in reducing the oxide phases and, because of this reaction, there is no free hydrogen to diffuse into steel and cause a hydrogen embrittlement effect. All these reactions which form ceramic layers occur on the steel surface, which increases the yield of ceramic surface formation by enhancing the rate of reduction and nitridation.

TABLE 2

Chemical-bonded ceramic on steel surface

| Sample | Ceramic surface | | |
|---|---|---|---|
| | $Al_2O_3$ | $Si_3N_4$ | TiN |
| 1200 - 10 min | ✓ | | |
| 1200 - 20 min | ✓ | | ✓ |
| 1200 - 30 min | ✓ | ✓ | ✓ |
| 1200 - 60 min | ✓ | ✓ | ✓ |

Figure 17A:
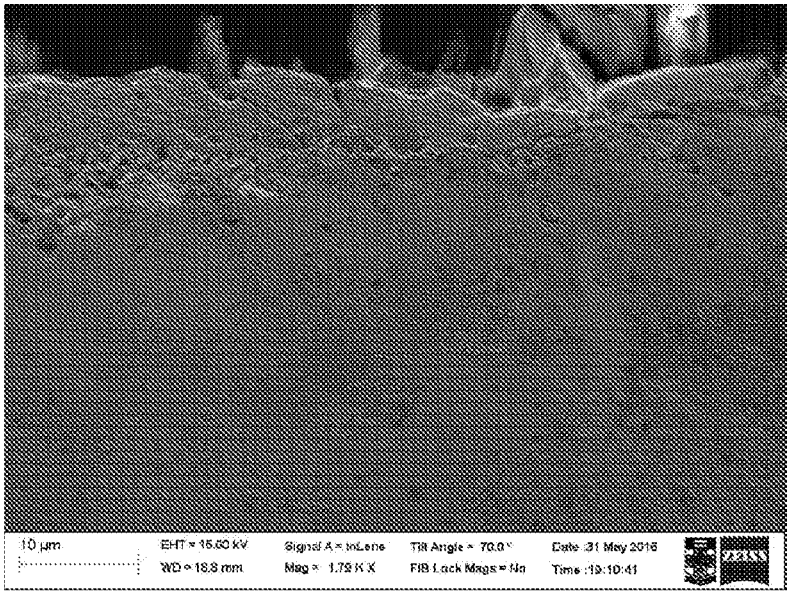
FIGS. 17A-17C show, respectively, SEM and EBSD phase maps of the surface of the treated steel, treated for 30 min as described in Example 8. (A) SEM image of chemically bonded ceramic surface on steel. (B) Selected area for EBSD phase map analysis. (C) Combined EBSD phase map of all phases.
Figure 17B:
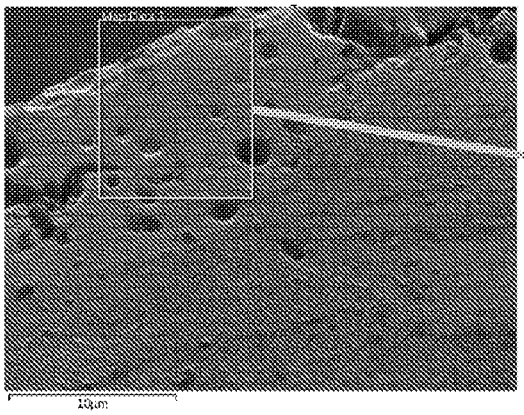
Figure 17C:
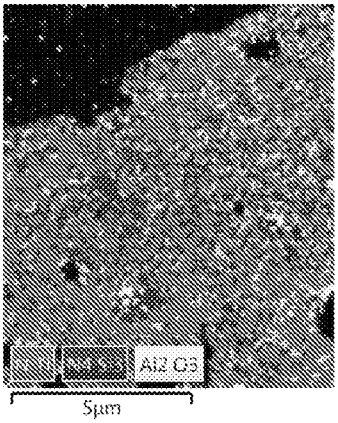

The cross-section of a sample heat treated at 1200° C. for 60 minutes was investigated using the SEM and EBSD micrograph to identify the morphology of different ceramic phases on the sample's surface. As shown in FIG. 17A, a ceramic layer has formed on the steel surface and, according to the EBSD analyses, which identify the crystallographic information and orientation of the grains and has been shown in FIGS. 17B and 17C, this ceramic surface is the combination of TiN, $Al_2O_3$ and $Si_3N_4$ phases, as these ceramic phases form simultaneously. These ceramic phases formed on the steel surface increase its hardness and, as they are chemically-bonded to the steel surface, they will resist applied force better than physically bonded ceramic surfaces.

Figure 18:
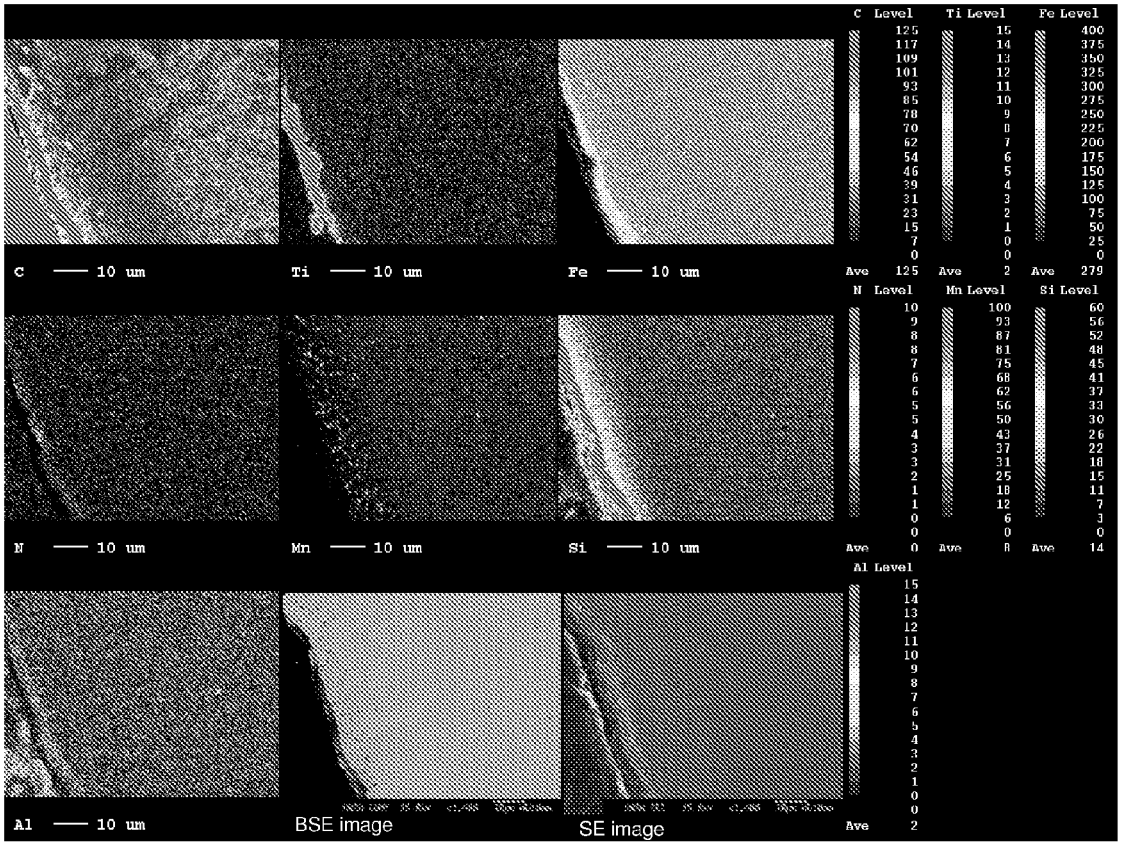
FIG. 18 shows EPMA X-ray intensity maps for C, N, Ti, Fe, Mn, Al and Si Kα of the surface and near-surface region of the treated steel, as described in Example 8. The relative concentration of these elements is indicated by colour, with blue indicating lower concentration and red higher concentration.

FIG. 18 shows the EPMA results for the distribution of C, N, Ti, Fe, Mn, Al and Si from the ceramic surface to the bulk steel structure and SEM images of the ceramic surface. SEM and EPMA results reveal the structural continuity of the ceramic surface and steel substrate, indicating that the ceramic surface has been grown from ASR and chemically bonded to the steel surface. Due to the larger amount of Si in the ASR the silicon nitride, which is in combination with silicon carbide layer, is thicker than the titanium nitride layer. There is a diffusion of these elements into the steel's structure as it can be seen from the gradient of the elements' concentrations in FIG. 18 and all the reactions have occurred on the steel surface. Carbon and manganese maps show that by increasing the heat treatment time, carbon starts to diffuse into the steel and react with Mn in the steel structure, forming manganese carbide. These results show that at the early stage of heat treatment carbon atoms are bonded to the surface by the formation of an Al—O bond but as heat treatment time increases carbon starts to diffuse into the steel and carbide phases will be formed. EPMA mapping clearly indicated that a chemical-bonded ceramic surface is formed on the steel surface and, by diffusion of carbon, sub-micron carbide phases will form near the surface region, increasing the hardness of the surface.

Further analysis on these samples was also conducted (see Example 9).

Example 9

Figure 19A:
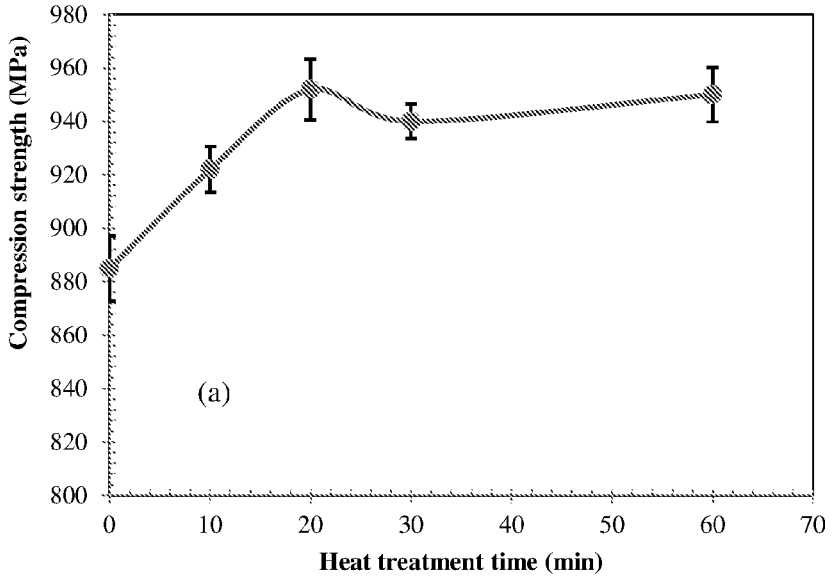
FIGS. 19A and 19B show the measured compressive strength and hardness respectively of the samples described in Example 9.

In order to assess the mechanical properties of the samples discussed in Examples 7 and 8, the samples were subjected to compression testing and micro-indentation hardness testing. The compression testing was conducted using Instron 5982 equipped with BlueHill 3 analysis software, using a 100 kN load cell and a loading rate of 0.5 mm/min. The results of the compression tests are shown in Table 4 and FIG. 19A. The micro-indentation hardness testing was conducted using Hysitron instrument equipped with Tribo Scan analysis software, with a maximum load of 5000 μN/sec with a loading and unloading rate of 500 μN/sec and dwell time of 5 seconds. The results of the micro-indentation hardness testing are shown in Table 5 and FIG. 19B.

TABLE 4

Compression test of surface treated samples prepared at 1200° C., using ASR, for varying times.

| Sample | Compression strength (MPa) |
|---|---|
| Raw sample | 885 |
| 10 min | 922 |
| 20 min | 952 |
| 30 min | 940 |
| 60 min | 950 |

TABLE 5

Micro-indentation hardness test of surface treated samples prepared at 1200° C., using ASR, for varying times. Hardness measured at the surface, 40 micrometres from the surface and from the centre of the sample.

| Sample | Hardness strength (GPa) | | |
|---|---|---|---|
| | Surface | 40 μm | Centre |
| 10 min | 4 | 3.56 | 3.56 |
| 20 min | 4.5 | 4.3 | 3.39 |
| 30 min | 4.6 | 3.7 | 3.38 |
| 60 min | 5.2 | 3.7 | 2.98 |

The compressive strength of the steel samples is postulated to be representative of the formation of the hardened surface and increases in grain size. After heat treatment and formation of the hardened surface (i.e. after formation of the ceramic phase), increases in compressive strength were observed. With longer heat treatment times, the grain sizes increased, which led to a reduction or plateauing of compressive strength being observed. After about 30 minutes of heat treatment, grain growth dominance becomes more important, with no significant increase in compressive strength being observed.

Figure 19B:
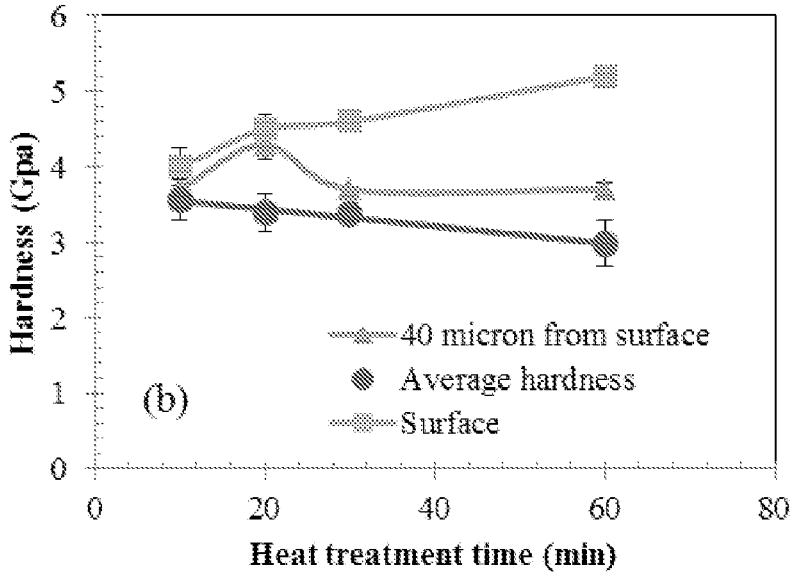
Figure 20A:
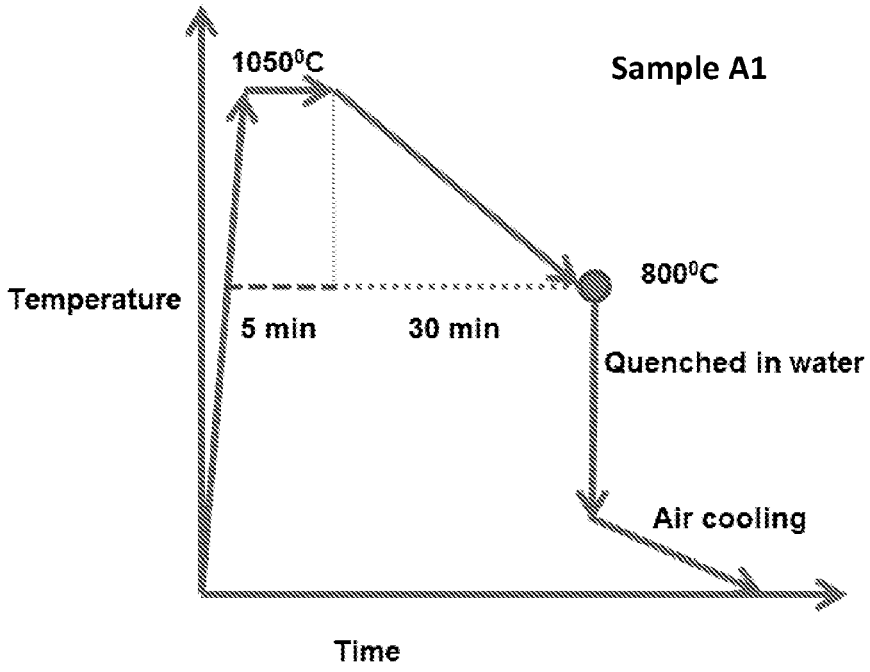
FIGS. 20A-20*f* show the different heating profiles for 40 mm grinding balls used as grinding media, having a carbon content of 1 wt. %, as described in Example 10.
Figure 20B:
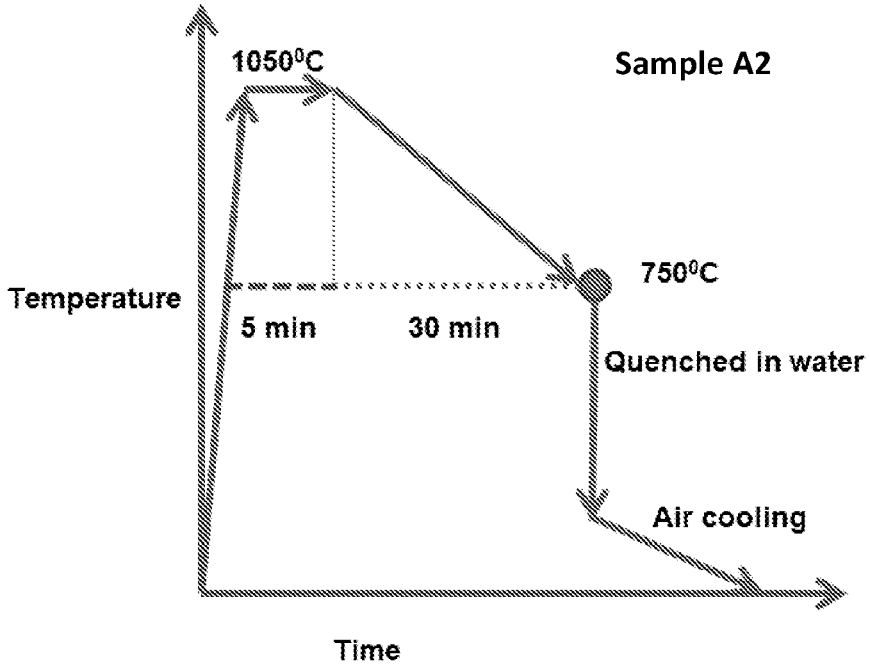
Figure 20C:
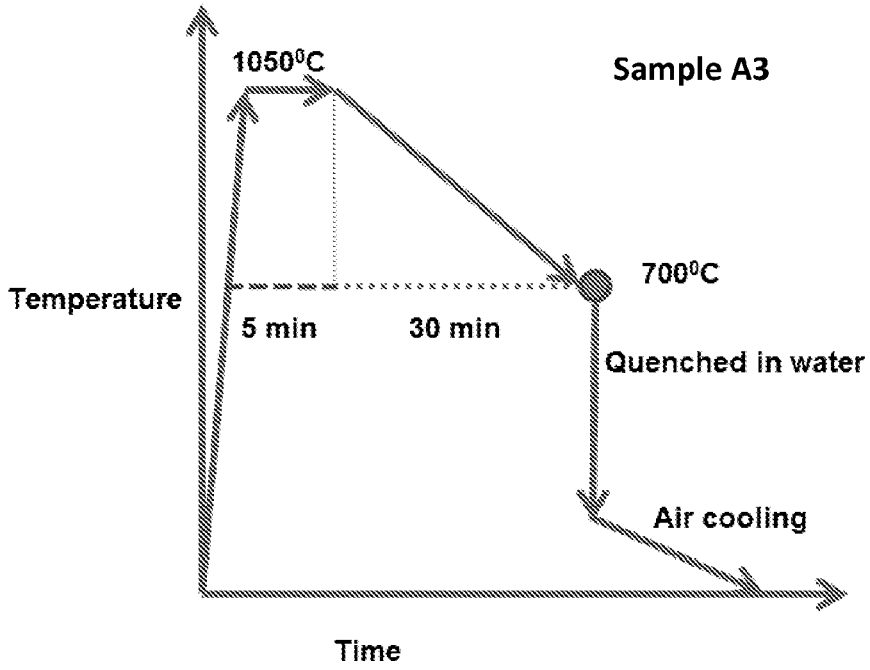
Figure 20D:
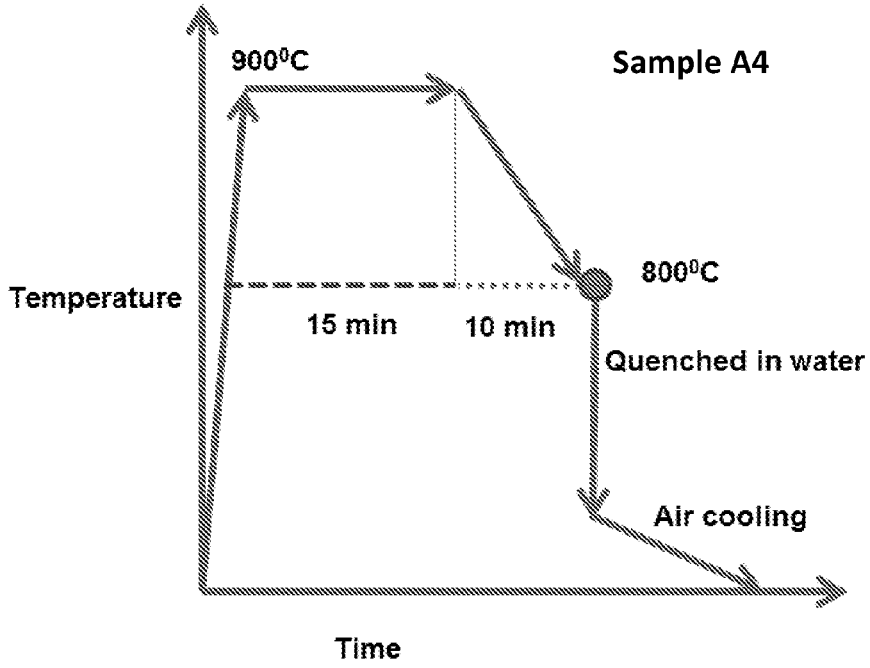
Figure 20E:
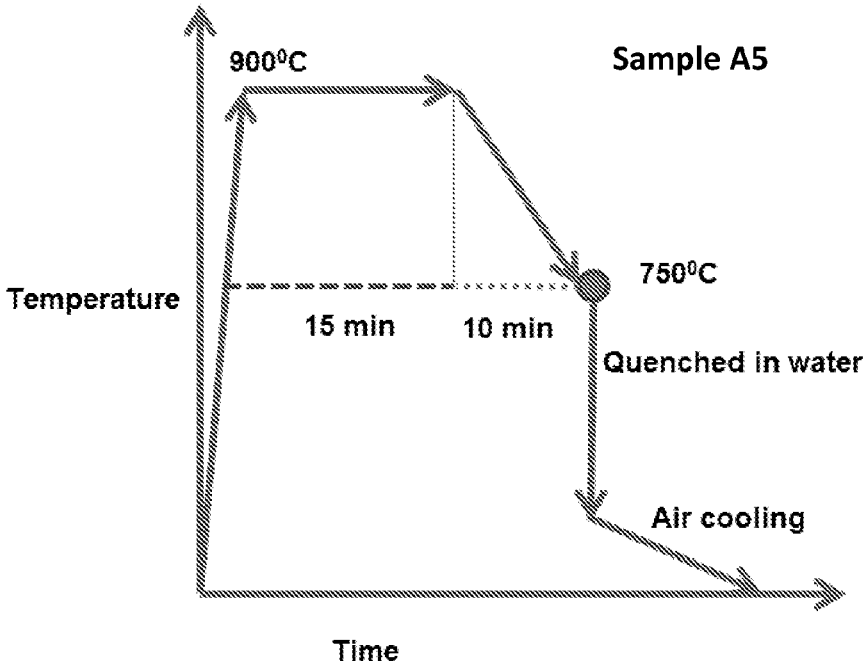
Figure 20F:
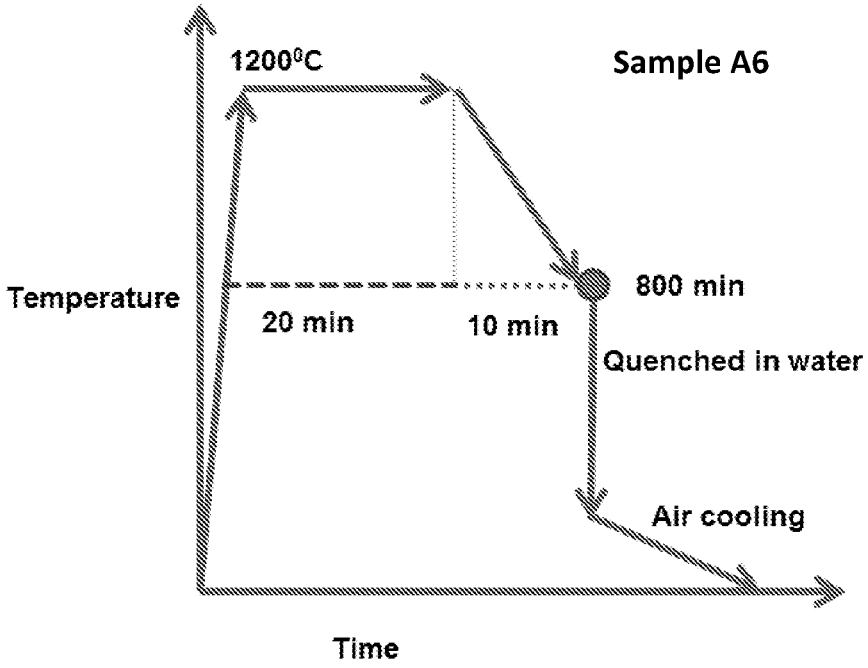

FIG. 19B shows the surface hardness of the samples, the hardness at 40 microns from the surface, as well as the average hardness of the samples at the centre. The increased grain size caused a small reduction in the average hardness of the steel at its centre. However, increasing heating time increases the thickness of the ceramic surface as well as diffusion of carbon into the steel and the formation of the sub-micron manganese carbide phase, and therefore an increase in the steel's is surface hardness. As shown in FIG. 19B, an increase in average hardness was also observed with longer treatment times.

By increasing the heat treatment time, the thickness of the ceramic surface increases and both the diffusion of carbon into the steel structure and the formation of the manganese carbide phase are initiated; increasing the hardness of steel surface as indicated in FIG. 19B. By increasing the heat treatment time, the concentration of diffused carbon and its diffusion depth will change and, at the same time, manganese carbides' size increase and their population start to decrease. This results in decreasing the hardness at 40 micron from surface after between 20 minute and 30 minute heat treatment. But, by increasing the heat treatment time from 30 minute to 60 minutes there is small increase in hardness at 40 micron from surface, due to the increase in diffused carbon. These results indicate that by controlling the heat treatment to control the grain size, carbon diffusion as well as thickness of the ceramic surface can achieve greater gains in hardness thereby enabling the tailoring of the desired mechanical property on the surface, near the surface and at the centre of the steel.

The hardness results indicate that the product's optimal strength may be attained by balancing gains in surface hardness due to longer heat times against potential losses in compression strength due to grain size increases, or by pinning the grains using a secondary phase to avoid grain growth due to heat treatment.

Example 10

In order to assess the suitability of alternative complex polymeric waste sources to form a hardened surface on ferro-alloy objects in the form of high carbon steel (1 wt. % carbon), in situ analysis of a combination of metallised plastics in the form of shredded snack packaging 116 and ASR 117 with a high carbon steel was conducted according to the procedures outlined in Example 7, with samples being heat treated at different temperature profile.

In the analysis, the ferro-alloy object was 40 mm grinding balls used as grinding media, having a carbon content of 1 wt. %. The ferro-alloy samples were each packed in a container with 80 g of ASR and 20 g of metallised plastic.

Samples were subject to different heating profiles, including varying isostatic hold and cooling times as shown in FIGS. 20A-20F. All samples were water quenched and air cooled after undergoing their respective heating profile.

The mechanical properties of the samples were assessed by micro-indentation hardness testing, conducted in accordance with the procedure outlined in Example 9. The results of the micro-indentation hardness testing are shown in Table 6. The results show that higher average surface hardness was generally obtained with higher isostatic hold temperatures and times. It is postulated that these higher hardness values are due to the surface treatment process forming a thicker ceramic layer at increased temperature and time.

TABLE 6

Micro-indentation hardness test of surface treated grinding ball samples prepared under different heating profiles, using ASR and metallised polymer.

| Sample | Average Hardness (MPa) |
|---|---|
| Untreated | 797 |
| A1 | 980 |
| A2 | 1021 |
| A3 | 837 |
| A4 | 901 |

TABLE 6-continued

Micro-indentation hardness test of surface treated grinding ball samples prepared under different heating profiles, using ASR and metallised polymer.

| Sample | Average Hardness (MPa) |
|---|---|
| A5 | 886 |
| A6 | 1032 |

Example 11

Figure 21A:
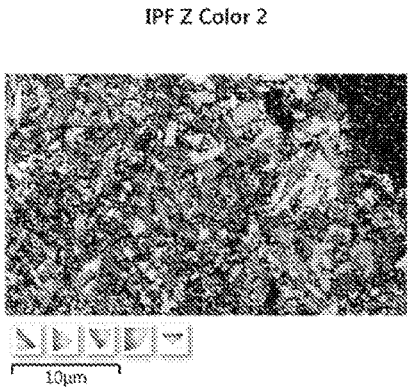
FIGS. 21A-21C show SEM and EBSD phase maps of the surface of the treated steel, treated as described in Example 10. (A) Selected area EBSD phase map analysis, (B) Combined EBSD phase map of all phases, (C) SEM image of chemically bonded ceramic surface on steel.
Figure 21B:
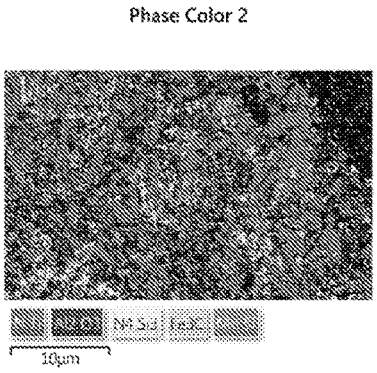
Figure 21C:
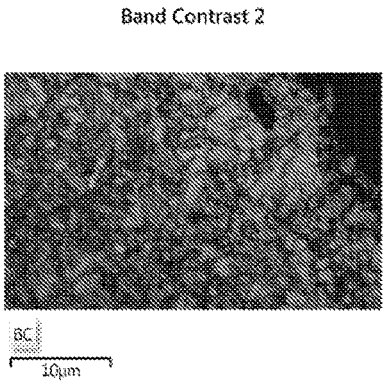

Further analysis of the samples treated in Example 10 were conducted in accordance with the procedure outlined in Example 8. The analysis showed the same mechanism occurring in the production of a ceramic surface. As shown in FIGS. 21A, 21B and 21C, a ceramic layer has formed on the steel surface. According to EBSD analyses, which identified the crystallographic information and orientation of the grains, the ceramic surface was found to be a combination of TiN, $Al_2O_3$ and $Si_3N_4$ phases, as these ceramic phases form simultaneously.

Figure 22:
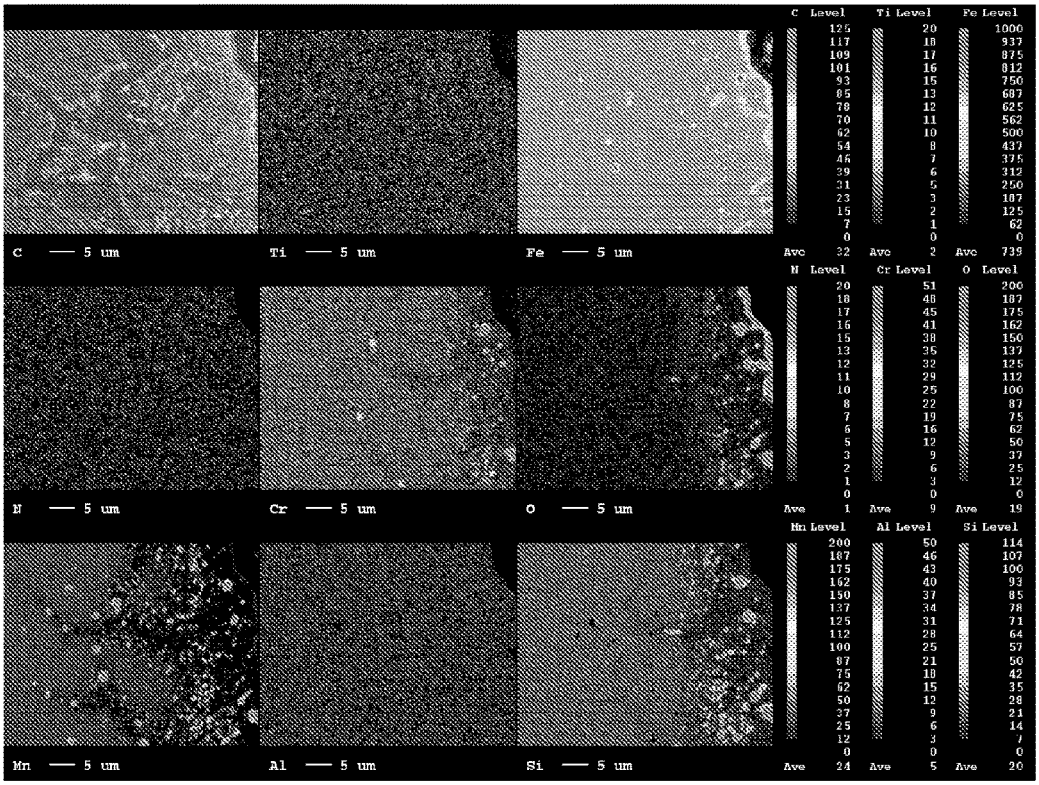
FIG. 22 shows EPMA X-ray intensity maps for C, Ti, Fe, N, Cr, O, Mn, Al and Si at the high-carbon steel surface and near-surface region, with contrast indicating the relative concentration of these elements.

FIG. 22 shows the EPMA results for the distribution of C, Ti, Fe, N, Cr, O, Mn, Al and Si from the ceramic surface to the bulk steel structure and SEM images of the ceramic surface. SEM and EPMA results reveal the structural continuity of the ceramic surface and steel substrate, indicating that the ceramic surface has been grown from ASR and chemically bonded to the high-carbon steel surface, in a similar manner to that of the 0.4% carbon steel of Example 8. Due to the larger amount of Si in the ASR the silicon nitride, which is in combination with silicon carbide layer, is thicker than the titanium nitride layer. There is a diffusion of these elements into the steel's structure as it can be seen from the gradient of the elements' concentrations in FIG. 22 and all the reactions have occurred on the steel surface. Carbon and manganese maps show that by increasing the heat treatment time, carbon starts to diffuse into the steel and react with Mn in the steel structure, forming manganese carbide, as for Example 8. These results show that at the early stage of heat treatment carbon atoms are bonded to the surface by the formation of an Al—O bond but as heat treatment time increases carbon starts to diffuse into the steel and carbide phases will be formed. EPMA mapping clearly indicated that a chemical-bonded ceramic surface is formed on the high-carbon steel surface and, by diffusion of carbon, sub-micron carbide phases will form near the surface region, increasing the hardness of the surface.

These ceramic phases formed on the steel surface increase its hardness and, as they are chemically-bonded to the steel surface, they will resist applied force better than physically bonded ceramic surfaces.

Example 12

In order to assess the mechanical properties of the grinding ball samples discussed in Examples 10 and 11, two such samples (A and B) were subjected to micro-indentation hardness testing, in accordance with the method of Example 9. Hardness values where measured from the treated surface, toward the centre of the samples.

Figure 23:
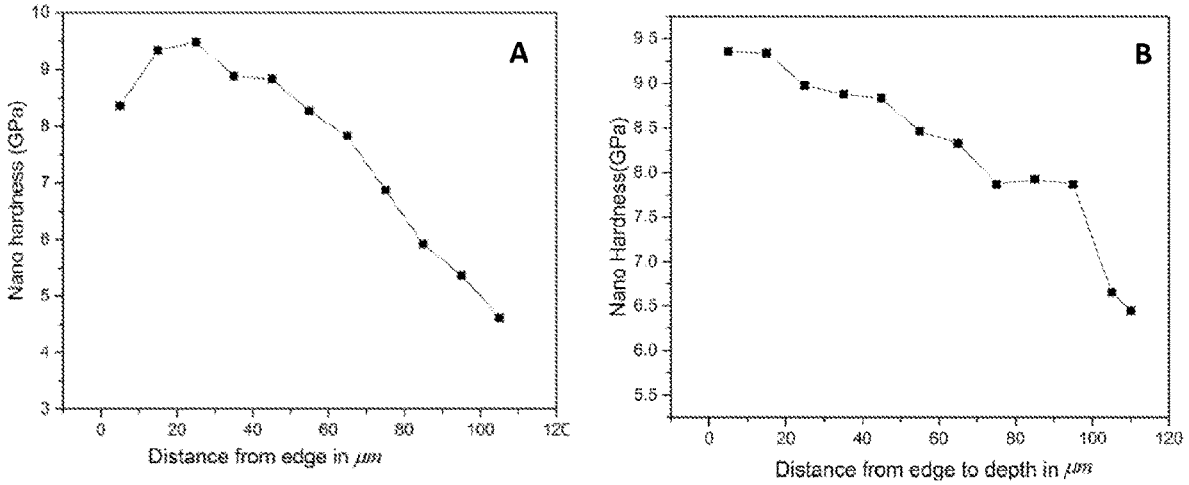
FIGS. 23A and 23B show the measured hardness of the samples described in Example 12.

The results of the micro-indentation hardness testing for samples A and B are shown in Tables 7 and 8, and FIGS. 23A and B.

TABLE 7

Micro-indentation hardness test of surface treated grinding ball sample A, from surface to centre, using ASR and metallised polymer.

| Distance from edge (μm) | Hardness (GPa) |
|---|---|
| 5 | 8.360436 |
| 15 | 9.336877 |
| 25 | 9.478746 |
| 35 | 8.881148 |
| 45 | 8.833616 |
| 55 | 8.265196 |
| 65 | 7.828062 |
| 75 | 6.870167 |
| 85 | 5.924785 |
| 95 | 5.370167 |
| 105 | 4.618206 |

TABLE 8

Micro-indentation hardness test of surface treated grinding ball sample B, from surface to centre, using ASR and metallised polymer.

| Distance from edge (μm) | Hardness (GPa) |
|---|---|
| 5 | 9.360436 |
| 15 | 9.336877 |
| 25 | 8.978746 |
| 35 | 8.881148 |
| 45 | 8.833616 |
| 55 | 8.465196 |
| 65 | 8.328062 |
| 75 | 7.870167 |
| 85 | 7.924785 |
| 95 | 7.870167 |
| 105 | 6.654584 |

In both samples A and B, a clear trend of increasing hardness toward the surface of the grinding ball is observed, echoing the results of Example 9 and indicating the successful application of the surface treatment process to high-carbon grinding media.

Example 13

In order to assess the corrosion resistance provided by the surface treatment process, the samples discussed in Example 10 were subjected to corrosion testing in 1 molar sodium chloride solution over a period of days, with the total weight loss of the sample over the period measured. Untreated balls were also subjected to the same conditions for comparison. The results of corrosion testing on two untreated balls (BM 40 mm-1' and 'BM 40 mm-2') and a treated ball of Example 10 ('BM 40 mm ceramic coating') are given in Table 9.

TABLE 9

Corrosion testing of untreated and surface treated grinding.

| Days | BM 40 mm −1 | BM 40 mm −2 (g) | BM 40 mm ceramic coating (g) |
|---|---|---|---|
| 0 | 262.00 | 273.10 | 264.69 |
| 10 | 261.90 | 273.00 | 264.63 |
| 20 | 261.83 | 272.92 | 264.56 |
| 30 | 261.75 | 272.85 | 264.50 |
| Total Loss | 0.25 | 0.25 | 0.19 |

Example 14

Figure 24:
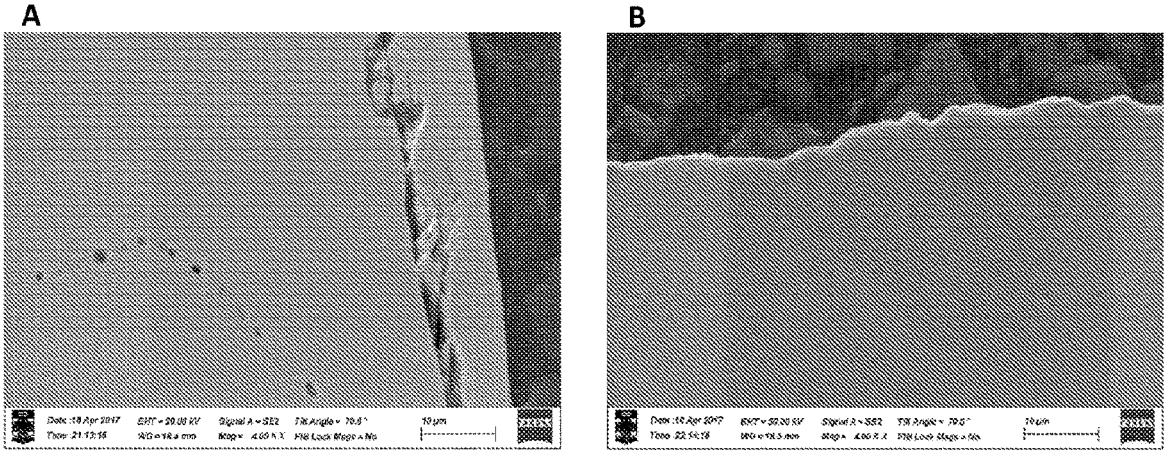
FIGS. 24A and 24B show SEM images of the effects of hydrogen on untreated and treated samples respectively, as described in Example 14.

Hydrogen embrittlement of steel is a known concern in heat treatment processes, as hydrogen may be absorbed by the steel at elevated temperatures. In order to assess the hydrogen absorption resistance provided by the present surface treatment process, the samples discussed in Example 10 were further analysed for hydrogen embrittlement, in comparison to samples having undergone the same thermal profile, but in the absence of surface treatment with ASR and metallised polymer. The results of hydrogen absorption analysis are given in FIG. 24 as SEM images.

FIG. 24A shows the results of hydrogen absorption in an untreated sample (no ceramic coating), with obvious surface cracking present. FIG. 24B shows the effect of the presence of the ceramic coating produced in the surface treatment process, with no cracking due to hydrogen embrittlement present. These results indicate that the ceramic layer produced in the present surface treatment process acts as an effective barrier to hydrogen absorption during the process.

Accordingly, it has been found that complex sources including carbon containing polymers, such as those found in complex industrial waste streams, are effective in providing hardened surfaces on ferro-alloy objects. Further, the composition of the bonded ceramic surface that may be formed may be influenced by the nature of the complex source; and as such, the complex source may be modified to suit the intended application of the ceramic surfaced steel and near-surface structure of steel. At the same time by precisely controlling the processing temperatures and reaction duration, the thickness of the ceramic surface can be controlled, as can its properties.

It will be understood to persons skilled in the art that many other modifications may be made without departing from the spirit and scope of the surface treatment processes disclosed herein.

In the claims which follow and in the preceding description, except where the context requires otherwise due to express language or necessary implication, the word "comprise" or variations thereof such as "comprises" or "comprising" is used in an inclusive sense, i.e. to specify the presence of the stated features but not to preclude the presence or addition of further features in various embodiments of the surface treatment processes disclosed herein.

The invention claimed is:

1. A method of hardening a surface of a ferro-alloy object, the method comprising:

at least partially gasifying a carbon-containing polymer to form a hardening material source; and exposing the object to the hardening material source, such that the hardening material source and the surface of the object react, thereby hardening the surface of the object, wherein the object is grinding media.

2. A method as claimed in claim 1, wherein the method includes heating the object prior to exposing the object to the hardening material source.

3. A method as claimed in claim 1, wherein the method includes simultaneously heating the object and forming the hardening material source.

4. A method as claimed in claim 1, wherein the polymer is at least partially gasified in a chamber that is separate to, but in fluid communication with, the object.

5. A method as claimed in claim 1, wherein the method includes heating the object and contacting the carbon-containing polymer with the heated object such that the carbon-containing polymer at least partially gasifies.

6. A method as claimed in claim 1, wherein the hardening material source and the surface of the object react by diffusion.

7. A method as claimed in claim 1, wherein the method includes selecting the duration for which the object is exposed to the hardening material source, to control a resulting thickness of the hardened surface.

8. A method as claimed in claim 1, wherein a temperature differential exists between the object and the polymer.

9. A method as claimed in claim 1, wherein the carbon-containing polymer comprises a metallized carbon-containing polymer.

10. A method according to claim 1, wherein the hardening material source and the surface of the object react by chemically bonding the hardening material source to the surface of the object to form a ceramic surface on the object.

11. A method according to claim 10, wherein the hardening material source includes ceramic forming agents that form the ceramic surface, wherein the ceramic forming agents include one or more ceramic phases that chemically bond with the ferro-alloy object, and wherein the ceramic phases that chemically bond with the ferro-alloy object comprise one or more of TiN, $Al_2O_3$, or $Si_3N_4$ phases.

12. A method according to claim 10, wherein the ceramic forming agents are selected from metal and/or ceramic disposed in a source containing the carbon-containing polymer, wherein the source includes an industrial waste stream that comprises metallized food packaging, automotive shredder residue, or a combination thereof.

13. A method according to claim 10, wherein the ceramic surface inhibits hydrogen absorption into the object.

14. A method of forming grinding media having a ferro-alloy substrate and a hardened ceramic surface, the method comprising: forming the ceramic surface on the ferro-alloy substrate by reacting a hardening material source with the ferroalloy substrate, the hardening material source being formed at least in part from a source incorporating one or more carbon-containing polymers and one or more of metal or ceramic.

15. A method according to claim 14, wherein the source is heated to form the hardening material source with the carbon-containing polymer at least partially gasified and containing one or more ceramic phases that chemically bond with the ferro-alloy substrate.

16. A method according to claim 14, wherein the ferro-alloy substrate is heated to promote the reaction between the hardening material source and the substrate.

17. A method according to claim 14, wherein the source comprises aluminum, silicon, titanium, or a combination thereof.

18. A method according to claim 14, wherein the source is derived at least in part from an industrial waste stream, and wherein the industrial waste stream comprises metallized food packaging, automotive shredder residue, or a combination thereof.

19. A method according to claim 14, further comprising, prior to the forming the ceramic surface on the ferro-alloy substrate, manufacturing the grinding media.

20. A method of hardening a surface of a ferro-alloy object, the method comprising:

at least partially gasifying a carbon-containing polymer to form a hardening material source; and exposing the object to the hardening material source, such that the hardening material source and the surface of the object react, thereby hardening the surface of the object, wherein the hardening material source and the surface of the object react by chemically bonding the hardening material source to the surface of the object to form a ceramic surface on the object, wherein the hardening material source includes ceramic forming agents that form the ceramic surface, wherein the ceramic forming agents include one or more ceramic phases that chemically bond with the ferro-alloy object, and wherein the ceramic phases that chemically bond with the ferro-alloy object comprise one or more of TiN, $Al_2O_3$, or $Si_3N_4$ phases.

* * * * *